US010189255B2

(12) United States Patent
Kobayashi

(10) Patent No.: US 10,189,255 B2
(45) Date of Patent: Jan. 29, 2019

(54) LIQUID DISCHARGE HEAD AND RECORDING DEVICE

(71) Applicant: KYOCERA Corporation, Kyoto-shi, Kyoto (JP)

(72) Inventor: Naoki Kobayashi, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 15/522,661

(22) PCT Filed: Mar. 18, 2016

(86) PCT No.: PCT/JP2016/058783

§ 371 (c)(1),
(2) Date: Apr. 27, 2017

(87) PCT Pub. No.: WO2016/152798

PCT Pub. Date: Sep. 29, 2016

(65) Prior Publication Data

US 2017/0326877 A1 Nov. 16, 2017

(30) Foreign Application Priority Data

Mar. 23, 2015 (JP) ..... 2015-059680

(51) Int. Cl.
*B41J 2/14* (2006.01)

(52) U.S. Cl.
CPC ..... *B41J 2/1433* (2013.01); *B41J 2/14209* (2013.01); *B41J 2002/14225* (2013.01);
(Continued)

(58) Field of Classification Search
None
See application file for complete search history.

(56) References Cited

U.S. PATENT DOCUMENTS

2007/0058010 A1 3/2007 Nagashima
2007/0103519 A1 5/2007 Takahashi et al.
(Continued)

FOREIGN PATENT DOCUMENTS

JP 2009-056766 A 3/2009
JP 2009-143168 A 7/2009
(Continued)

OTHER PUBLICATIONS

Machine Translation of JP2009143168, Hirakata, Susumu et al., "Liquid Droplet Discharging Unit, Liquid Droplet Discharging Head, and Image Forming Appratus Equipped With It", Jul. 2, 2009, Fuji Xerox Co LTD, Paragraphs 0043-0062.*
(Continued)

*Primary Examiner* — Lisa M Solomon
(74) *Attorney, Agent, or Firm* — Volpe and Koenig, P.C.

(57) ABSTRACT

A liquid discharge head includes a flow passage member and a plurality of pressurizing sections. The flow passage member includes a plurality of discharge holes, a plurality of pressurizing chambers respectively connected to a plurality of the discharge holes, a plurality of first flow passages respectively connected to a plurality of the pressurizing chambers, a second flow passage commonly connected to a plurality of the first flow passages, a plurality of third flow passages respectively connected to a plurality of the pressurizing chambers, and a fourth flow passage commonly connected to a plurality of the third flow passages. A plurality of the pressurizing sections respectively pressurizes liquid in a plurality of the pressurizing chambers. A flow passage resistance in the third flow passages is lower than a flow passage resistance in the first flow passages. In the flow passage member, a damper is formed in the fourth flow passage.

17 Claims, 13 Drawing Sheets

(52) U.S. Cl.
CPC ..... *B41J 2002/14306* (2013.01); *B41J 2002/14419* (2013.01); *B41J 2002/14459* (2013.01); *B41J 2202/12* (2013.01); *B41J 2202/20* (2013.01); *B41J 2202/21* (2013.01)

(56) References Cited

U.S. PATENT DOCUMENTS

| | | | |
|---|---|---|---|
| 2011/0085012 | A1 | 4/2011 | Nishikawa et al. |
| 2011/0228012 | A1 | 9/2011 | Yoshida et al. |
| 2012/0176450 | A1 | 7/2012 | Akahane et al. |

FOREIGN PATENT DOCUMENTS

| | | | |
|---|---|---|---|
| JP | 2011-079251 | A | 4/2011 |
| JP | 2011-213094 | A | 10/2011 |
| JP | 2012-143948 | A | 8/2012 |

OTHER PUBLICATIONS

IP.com search.*
International Search Report, PCT/JP2016/058783, dated May 31, 2016, 2 pgs.
Partial European Search Report, European Patent Application No. 16768701.1, dated Nov. 14, 2017, 14 pgs.
Japanese Office Action, Japanese Application No. 2017-508325, dated Feb. 13, 2018, 3 pgs.

* cited by examiner

LIQUID DISCHARGE HEAD AND RECORDING DEVICE

TECHNICAL FIELD

The present invention relates to a liquid discharge head and a recording device.

BACKGROUND ART

Conventionally, there has been proposed, as a printing head, a liquid discharge head for performing various printing tasks by discharging, for example, liquid onto a recording medium. A known liquid discharge head includes a flow passage member and a plurality of pressurizing sections. The flow passage member includes a plurality of discharge holes, a plurality of pressurizing chambers respectively connected to a plurality of the discharge holes, a plurality of first flow passages respectively connected to a plurality of the pressurizing chambers, a second flow passage commonly connected to a plurality of the first flow passages, a plurality of third flow passages respectively connected to a plurality of the pressurizing chambers, and a fourth flow passage commonly connected to a plurality of the third flow passages. A plurality of the pressurizing sections respectively pressurizes liquid in a plurality of the pressurizing chambers (for example, see PATENT DOCUMENT 1).

RELATED ART DOCUMENT

Patent Document

Patent Document 1: Japanese Unexamined Patent Application Publication No. 2009-143168

SUMMARY OF THE INVENTION

A liquid discharge head according to the present disclosure includes a flow passage member and a plurality of pressurizing sections. The flow passage member includes a plurality of discharge holes, a plurality of pressurizing chambers respectively connected to a plurality of the discharge holes, a plurality of first flow passages respectively connected to a plurality of the pressurizing chambers, a second flow passage commonly connected to a plurality of the first flow passages, a plurality of third flow passages respectively connected to a plurality of the pressurizing chambers, and a fourth flow passage commonly connected to a plurality of the third flow passages. A plurality of the pressurizing sections respectively pressurizes liquid in a plurality of the pressurizing chambers. In addition, a flow passage resistance in the third flow passages is lower than a flow passage resistance in the first flow passages. In addition, in the flow passage member, a damper is formed in the fourth flow passage.

In addition, another liquid discharge head according to the present disclosure includes a flow passage member and a plurality of pressurizing sections. The flow passage member includes a plurality of discharge holes, a plurality of pressurizing chambers respectively connected to a plurality of the discharge holes, a plurality of first flow passages respectively connected to a plurality of the pressurizing chambers, a second flow passage commonly connected to a plurality of the first flow passages, a plurality of third flow passages respectively connected to a plurality of the pressurizing chambers, a fourth flow passage commonly connected to a plurality of the third flow passages, and a plurality of fifth flow passages respectively connected to a plurality of the pressurizing chambers. A plurality of the pressurizing sections respectively pressurizes liquid in a plurality of the pressurizing chambers. In addition, the fifth flow passages are commonly connected to the second flow passage. In addition, a flow passage resistance in the third flow passages is lower than a flow passage resistance in the first flow passages and a flow passage resistance in the fifth flow passages. In addition, in the flow passage member, a damper is formed in the fourth flow passage.

A recording device according to the present disclosure includes the liquid discharge head, a conveyor for conveying a recording medium toward the liquid discharge head, and a control section for controlling the liquid discharge head.

EMBODIMENTS FOR CARRYING OUT THE INVENTION

First Embodiment

Figure 1:
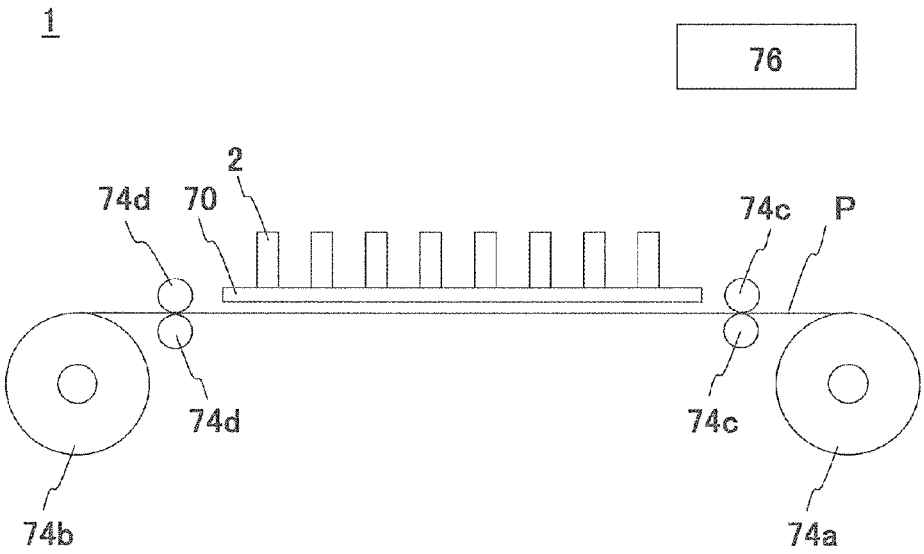
FIG. 1(*a*) is a side view schematically illustrating a recording device including a liquid discharge head, according to a first embodiment of the present invention, and FIG. 1(*b*) is a plan view schematically illustrating the recording device including the liquid discharge head, according to the first embodiment of the present invention.
Figure 1:
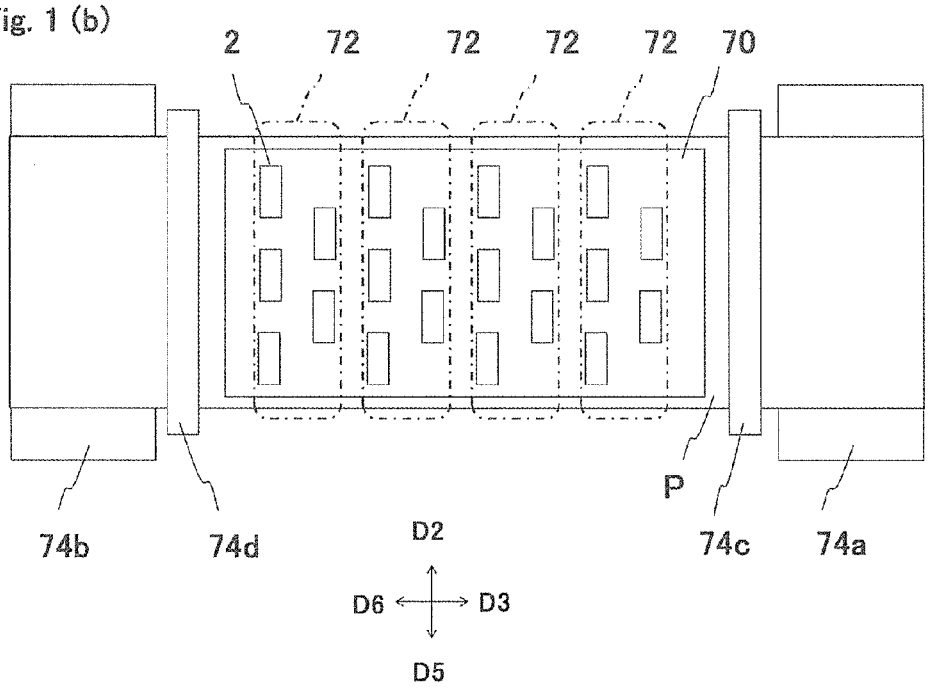

With reference to FIG. 1, a color inkjet printer 1 (hereinafter referred to as printer 1) including a liquid discharge head 2 according to a first embodiment of the present invention will now be described herein.

The printer 1 conveys a recording medium P from a conveying roller 74*a* to a conveying roller 74*b* to move the recording medium P relative to the liquid discharge head 2. A control section 76 controls the liquid discharge head 2 based on data such as an image and a text so as to discharge liquid toward the recording medium P to project droplets onto the recording medium P to perform printing on the recording medium P.

In the first embodiment, the liquid discharge head 2 is fixed to the printer 1 so that the printer 1 operates as a so-called line printer. Another embodiment of the recording device may be a so-called serial printer.

On the printer 1, a tabular frame 70 is fixed approximately parallel to the recording medium P. On the frame 70, twenty (20) holes (not shown) are provided, and the twenty (20) liquid discharge heads 2 are respectively mounted over the holes. Five (5) liquid discharge heads 2 configure a head group 72, and the printer 1 has four head groups 72.

The liquid discharge head 2 has a thin, long shape, as shown in FIG. 1(*b*). In one head group 72, the three liquid discharge heads 2 are arranged along a direction intersecting a conveying direction of the recording medium P, while the other two liquid discharge heads 2 are each arranged between the three liquid discharge heads 2, but offset along the conveying direction. The adjoining liquid discharge heads 2 are disposed to join regions printable with the liquid discharge heads 2 in a width direction of the recording medium P, or to allow edges of the printable regions to overlap so that printing is possible in a seamless manner in the width direction of the recording medium P.

The four head groups 72 are disposed along the conveying direction of the recording medium P. The liquid discharge heads 2 are each supplied with ink from a liquid tank (not shown). The liquid discharge heads 2 belonging to the one head group 72 are supplied with ink of an identical color, thus the four head groups perform a print with inks of four colors. Colors of inks each discharged from the head groups 72 include, for example, magenta (M), yellow (Y), cyan (C), and black (K).

Moreover, a number of the liquid discharge heads 2 included in each of the head groups 72 or a number of the head groups 72 may be appropriately changed depending on a print target or a print condition. For example, in order to perform further multi-color printing, a number of the head groups 72 may be increased. In addition, by disposing a plurality of the head groups 72 for printing with an identical color to alternately perform printing in the conveying direction, a print speed, i.e. conveying speed, can be increased. In addition, by preparing and disposing a plurality of the head groups 72 for printing in an identical color in a direction intersecting with the conveying direction, a resolution in a width direction of the recording medium P may be increased.

Further, in addition to performing printing with a colored ink, liquid such as a coating agent may be printed to perform a surface treatment for the recording medium P.

The printer 1 performs printing onto the recording medium P. The recording medium P wound onto the conveying roller 74*a* passes between two conveying rollers 74*c*, and then passes under the liquid discharge heads 2 mounted on the frame 70. After that, the recording medium P passes between other two conveying rollers 74*d*, and is finally collected by the conveying roller 74*b*.

The recording medium P may be cloth, in addition to printing paper. In addition, instead of the recording medium P, the printer 1 may convey a conveying belt, and, in addition to a roll-shaped recording medium P, a sheet paper, a cut piece of cloth, a wooden material, or a tile may be placed on the conveying belt. Further, the liquid discharge heads 2 may discharge liquid containing conductive particles to print a wiring pattern for an electronic device. Still further, the liquid discharge heads 2 may discharge, toward a reactor vessel, a predetermined amount of a liquid chemical agent or liquid containing a chemical agent for reaction to produce a chemical product.

In addition, the printer 1 may be attached with a position sensor, a speed sensor, and a temperature sensor so that the control section 76 controls components of the printer 1 in accordance with conditions of the components based on information sent from the sensors. In particular, if a discharging characteristic (discharge amount, discharge speed, and others) of liquid discharged by the liquid discharge heads 2 is affected by an external factor, a drive signal that causes the liquid discharge heads 2 to discharge the liquid may be changed in accordance with a temperature in the liquid discharge heads 2, a liquid temperature in the liquid tank, and a liquid pressure applied from the liquid tank to the liquid discharge heads 2.

Next, with reference to FIGS. 2 to 10, the liquid discharge head 2 according to the first embodiment will now be described herein. Moreover, in FIGS. 5 and 6, for easy understanding of the drawings, flow passages and other components that position under other members, that typically are rendered with a broken line, instead are rendered with a solid line.

Moreover, drawings are shown with a first direction D1, a second direction D2, a third direction D3, a fourth direction D4, a fifth direction D5, and a sixth direction D6. The first direction D1 is a direction toward which a first common flow passage 20 and a second common flow passage 24 extend, and the fourth direction D4 is another direction toward which the first common flow passage 20 and the second common flow passage 24 extend. The second direction D2 is a direction toward which a first integrated flow passage 22 and a second integrated flow passage 26 extend, and the fifth direction D5 is another direction toward which the first integrated flow passage 22 and the second integrated flow passage 26 extend. The third direction D3 is a direction orthogonal to the direction toward which the first integrated flow passage 22 and the second integrated flow passage 26 extend, and the sixth direction D6 is another direction orthogonal to the other direction toward which the first integrated flow passage 22 and the second integrated flow passage 26 extend.

The liquid discharge head 2 is described with a first individual flow passage 12, as a first flow passage, a first common flow passage 20, as a second flow passage, a third individual flow passage 16, as a third flow passage, a second common flow passage 24, as a fourth flow passage, and a second individual flow passage 14, as a fifth flow passage.

Figure 2:
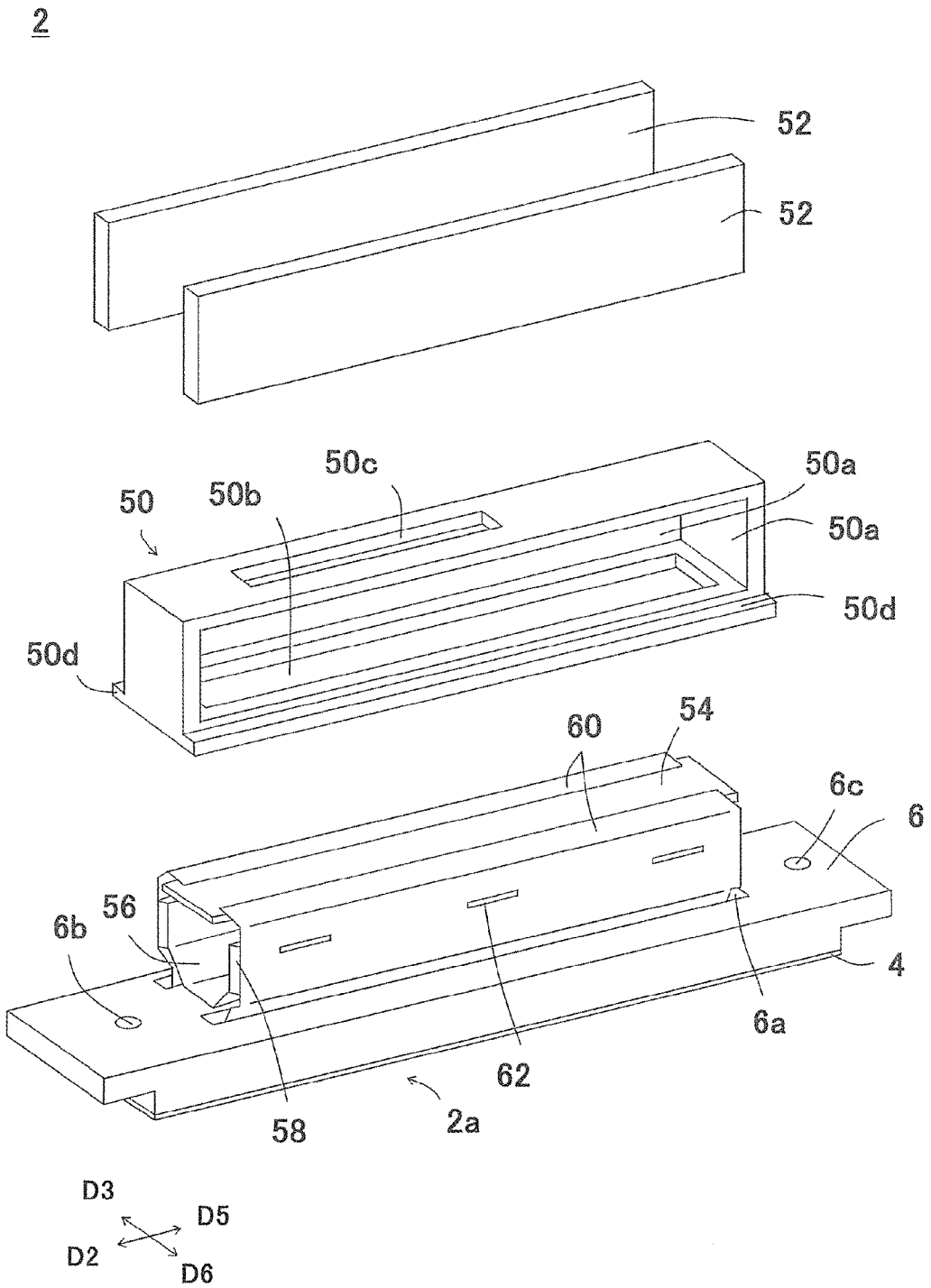
FIG. 2 is an exploded perspective view of the liquid discharge head according to the first embodiment of the present invention.
Figure 3:
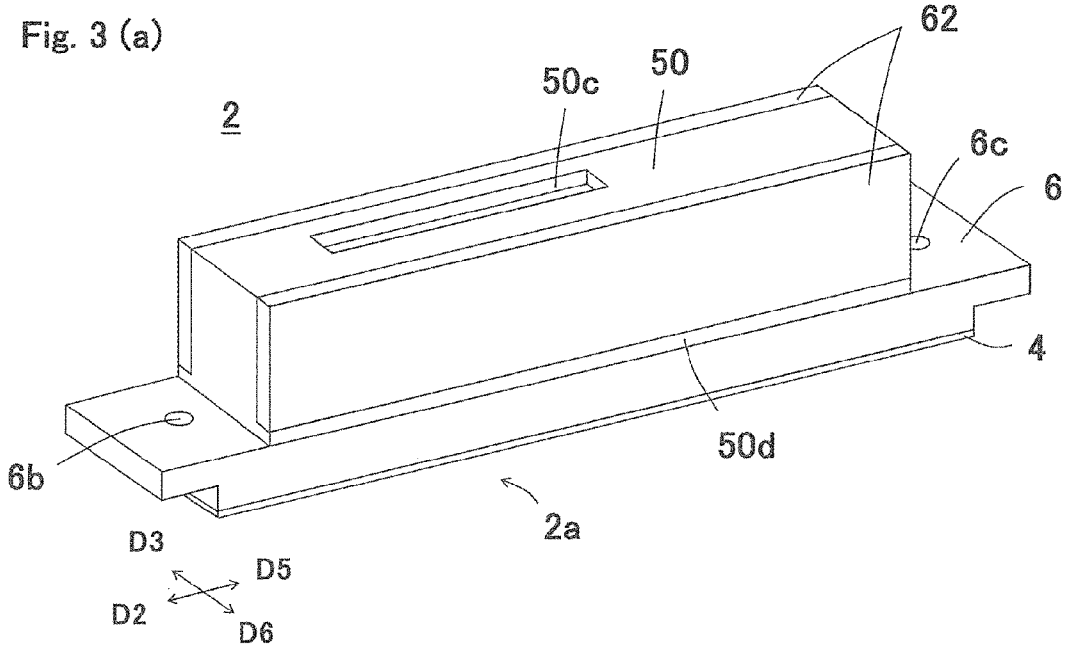
FIG. 3(*a*) is a perspective view of the liquid discharge head shown in FIG. 2, and FIG. 3(*b*) is a cross-sectional view of the liquid discharge head shown in FIG. 2.
Figure 3:
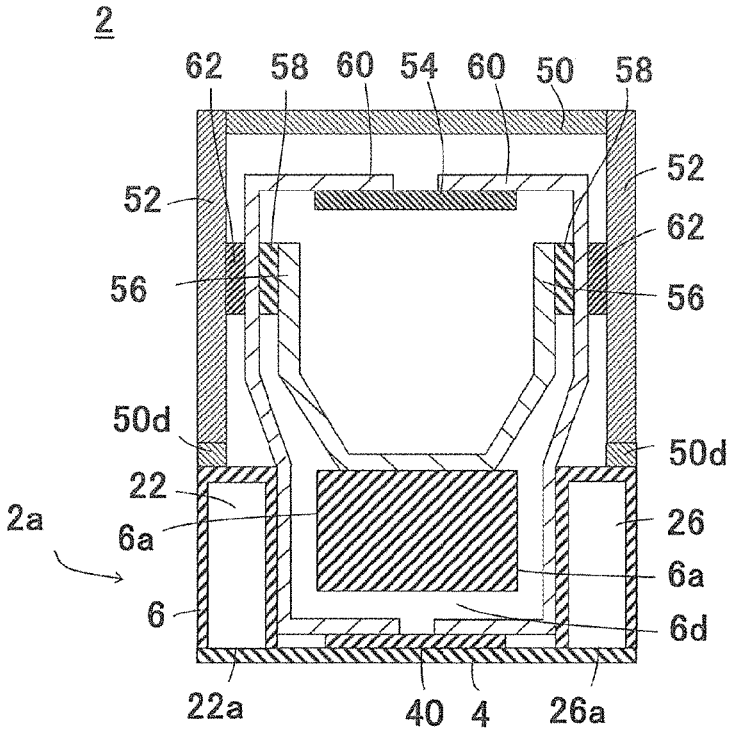

As shown in FIGS. 2 and 3, the liquid discharge head 2 includes a head body 2*a*, a housing 50, heat sinks 52, a circuit board 54, a press member 56, elastic members 58, signal transmission sections 60, and driver ICs 62. Moreover, the liquid discharge head 2 may at least include the head body 2*a*, and may not necessarily include the housing 50, the heat sinks 52, the circuit board 54, the press member 56, the elastic members 58, the signal transmission sections 60, and the driver ICs 62.

On the liquid discharge head 2, the signal transmission sections 60 extend from the head body 2*a*, and the signal transmission sections 60 are electrically connected to the circuit board 54. The signal transmission sections 60 are provided with the driver ICs 62 for driving and controlling the liquid discharge head 2. The driver ICs 62 are pressed onto the heat sinks 52 by the press member 56 via the elastic members 58. Moreover, a supporting member supporting the circuit board 54 is omitted from the drawings.

The heat sinks 52 may be formed of a metal or an alloy, and are provided to externally radiate heat of the driver ICs 62. The heat sinks 52 are joined to the housing 50 by means of a screw or an adhesive.

The housing 50 is mounted on an upper surface of the head body 2*a* so that the housing 50 and the heat sinks 52 cover each member configuring the liquid discharge head 2. The housing 50 includes first openings 50*a*, a second opening 50*b*, a third opening 50*c*, and thermal insulation sections 50*d*. The first openings 50*a* are provided to respectively face the third direction D3 and the sixth direction D6, and the first openings 50*a* are disposed with the heat sinks 52 so that the first openings 50*a* are sealed. The second opening 50*b* opens downwardly so that, via the second opening 50*b*, the circuit board 54 and the press member 56 are disposed inside the housing 50. The third opening 50*c* opens upwardly to house a connector (not shown) provided for the circuit board 54.

The thermal insulation sections 50*d* are provided to extend from the second direction D2 to the fifth direction D5, and are disposed between the heat sinks 52 and the head body 2*a*. Therefore, heat radiated to the heat sinks 52 is prevented as much as possible from being transmitted to the head body 2*a*. The housing 50 may be formed of a metal, an alloy, or a resin.

Figure 4A:
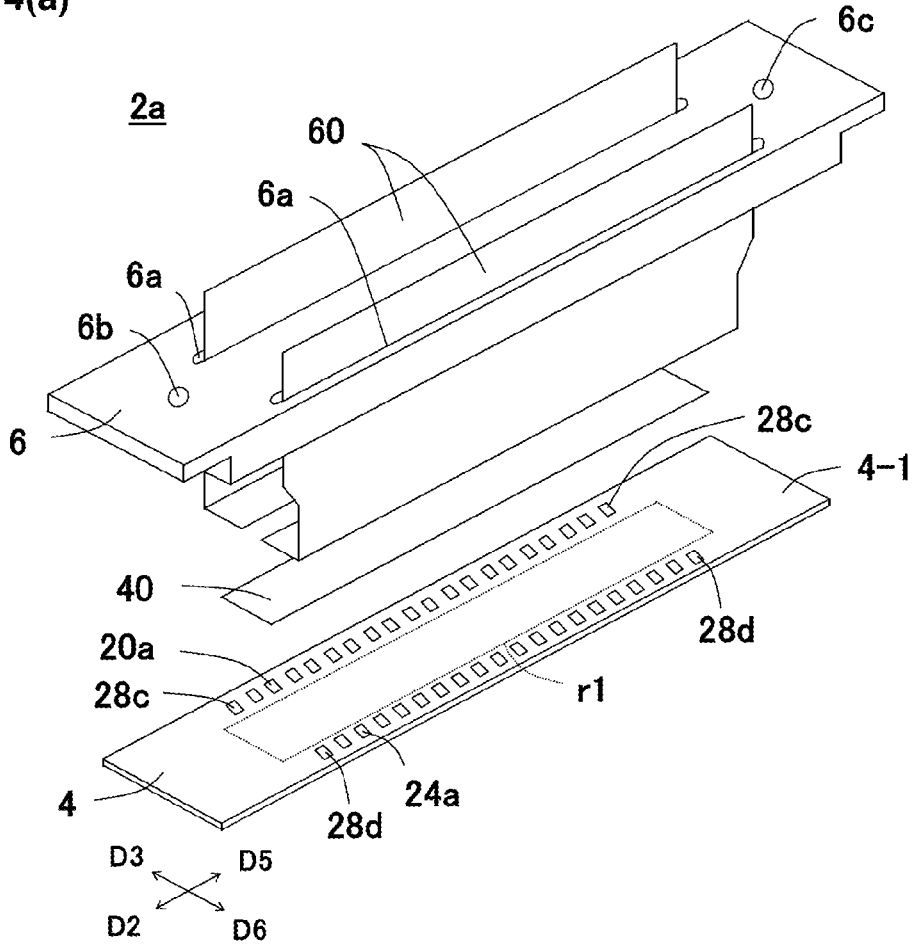
FIG. 4(*a*) is an exploded perspective view of a head body, and FIG. 4(*b*) is a perspective view of a second flow passage member when seen from an under surface of the second flow passage member.
Figure 4B:
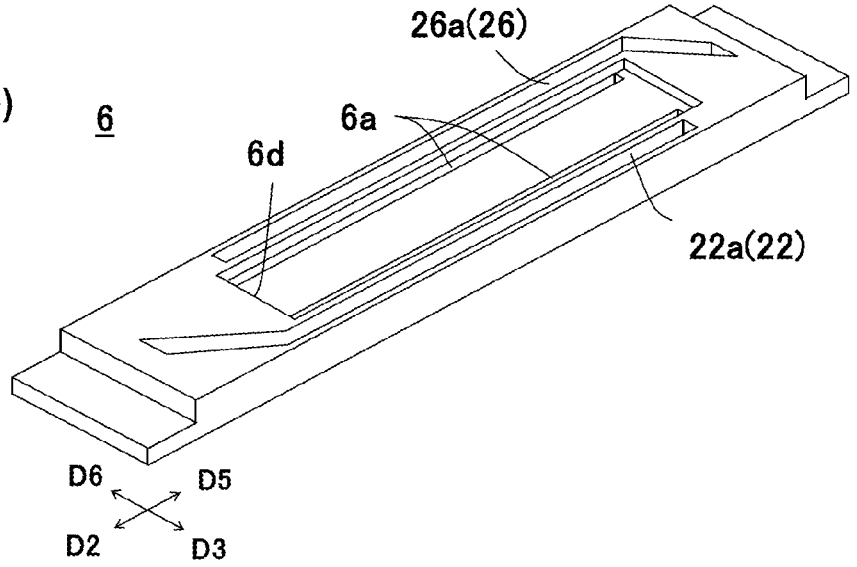

As shown in FIG. 4(*a*), the head body 2*a* has a tabular shape extending from the second direction D2 to the fifth direction D5, and has a first flow passage member 4, a second flow passage member 6, and a piezoelectric actuator substrate 40. On the head body 2*a*, the piezoelectric actuator substrate 40 and the second flow passage member 6 are disposed on an upper surface of the first flow passage member 4. The piezoelectric actuator substrate 40 is mounted in a region indicated with a broken line r1 in FIG. 4(*a*). The piezoelectric actuator substrate 40 is provided to pressurize a plurality of pressurizing chambers 10 (see FIG. 8) provided on the first flow passage member 4, and includes a plurality of displacement elements 48 (see FIG. 8).

Figure 8:
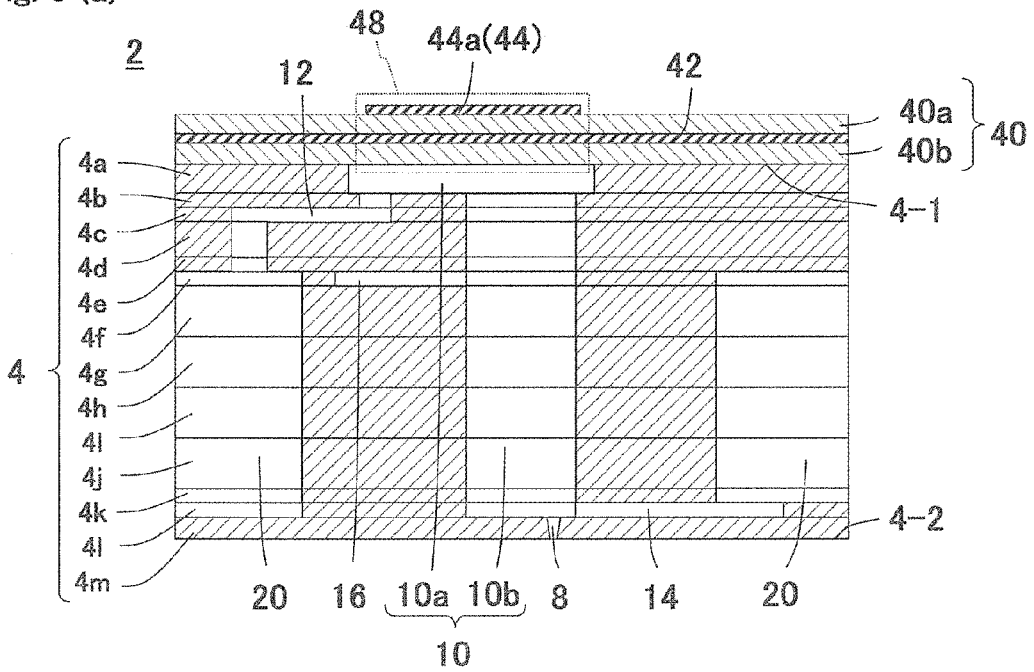
FIG. 8(*a*) is a cross-sectional view taken along the line VIIIa-VIIIa of FIG. 7(*b*), and FIG. 8(*b*) is a cross-sectional view taken along the line VIIIb-VIIIb of FIG. 7(*b*).
Figure 8:
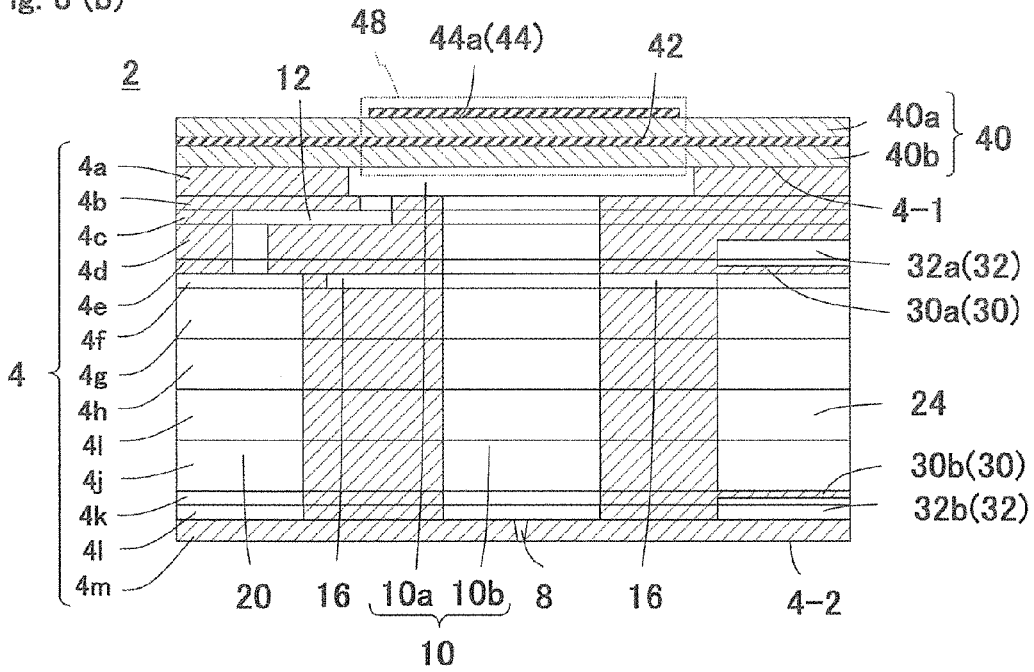

The first flow passage member 4 is internally formed with a plurality of flow passages to guide liquid supplied from the second flow passage member 6 to discharge holes 8 provided on an under surface (see FIG. 8). The first flow passage member 4 has, on its upper surface, a pressurizing chamber surface 4-1, and, on the pressurizing chamber surface 4-1, openings 20*a*, 24*a*, 28*c*, and 28*d* are formed. A plurality of the openings 20*a* is provided, and is arranged from the second direction D2 to the fifth direction D5. The openings 20*a* are disposed on an edge, in the third direction D3, of the pressurizing chamber surface 4-1. A plurality of the openings 24*a* is provided, and is arranged from the second direction D2 to the fifth direction D5. The openings 24*a* are disposed on another edge, in the sixth direction D6, of the pressurizing chamber surface 4-1. The openings 28*c* are provided on both outer sides, in the second direction D2 and the fifth direction D5, with the openings 20*a* provided therebetween. The openings 28*d* are provided on both outer sides, in the second direction D2 and the fifth direction D5, with the openings 23*a* provided therebetween.

The second flow passage member 6 is internally formed with a plurality of flow passages to guide liquid supplied from the liquid tank to the first flow passage member 4. The second flow passage member 6 is provided on an outer periphery portion of a pressurizing chamber surface 4-1 of the first flow passage member 4, and is joined to the first flow passage member 4, via an adhesive (not shown), outside the mount region of the piezoelectric actuator substrate 40.

Figure 5:
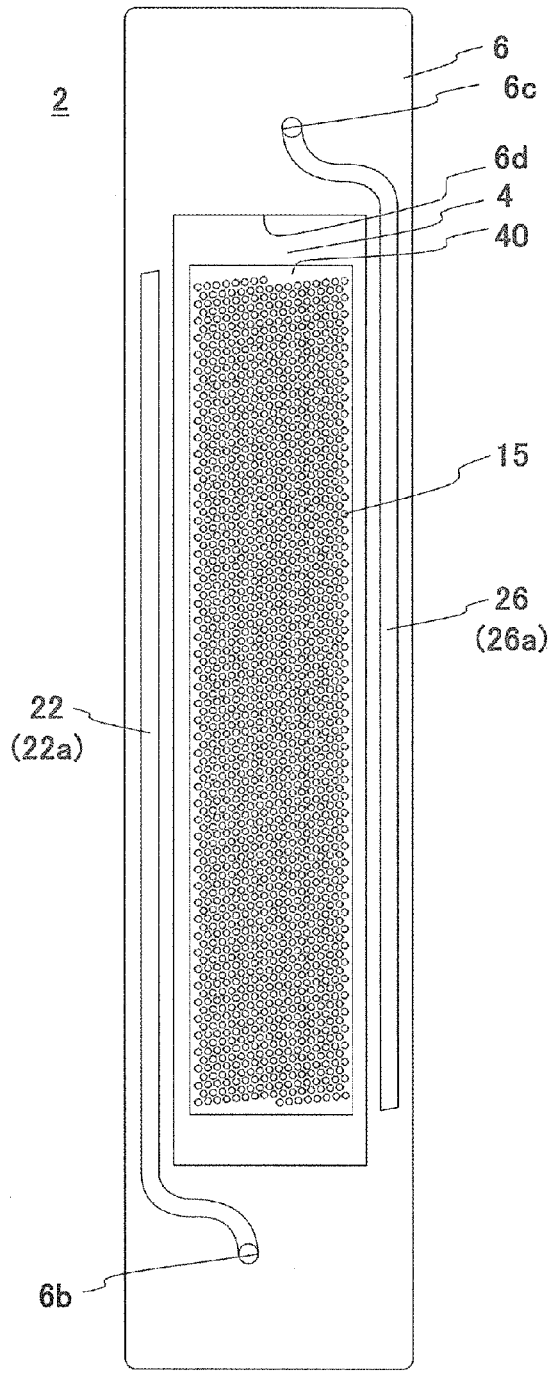
FIG. 5(*a*) is a plan view of the head body when the second flow passage member is partially made transparent, and FIG. 5(*b*) is another plan view of the head body when the second flow passage member is made transparent.
Figure 5:
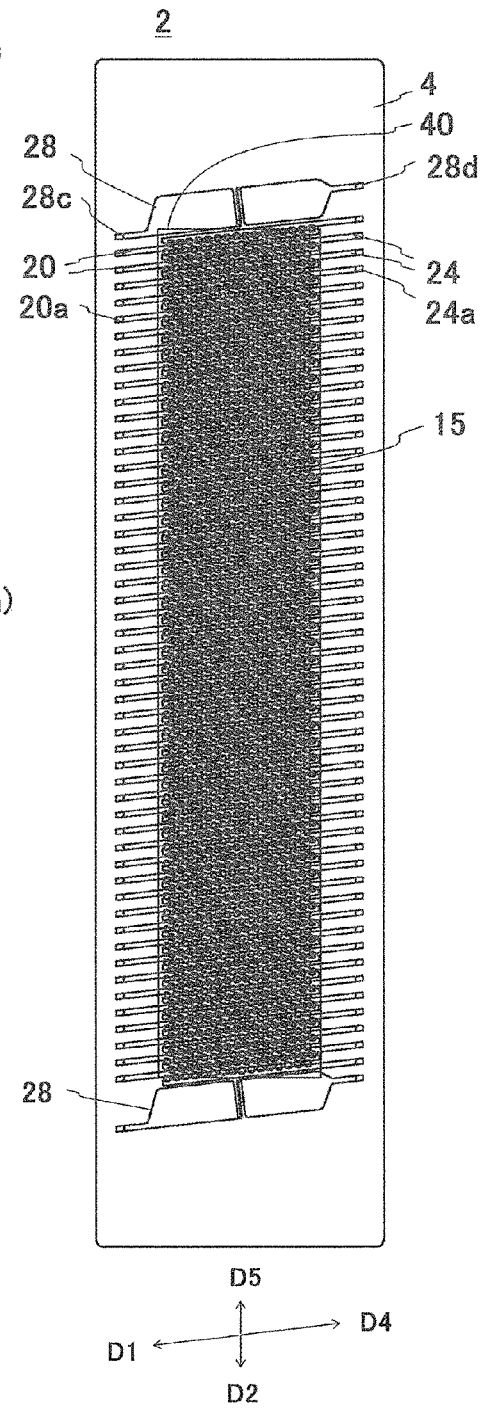

The second flow passage member 6 is, as shown in FIGS. 4 and 5, formed with through holes 6*a*, and openings 6*b*, 6*c*, 6*d*, 22*a*, and 26*a*. The through holes 6*a* are formed to extend from the second direction D2 to the fifth direction D5, and are disposed outside the mount region of the piezoelectric actuator substrate 40. The through holes 6*a* are inserted with the signal transmission sections 60.

The opening 6*b* is provided on an upper surface of the second flow passage member 6, and is disposed on an edge, in the second direction D2, of the second flow passage member. The opening 6*b* supplies liquid from the liquid tank to the second flow passage member 6. The opening 6*c* is provided on the upper surface of the second flow passage member 6, and is disposed on another edge, in the fifth direction D5, of the second flow passage member. The opening 6*c* collects the liquid from the second flow passage member 6 to the liquid tank. The opening 6*d* is provided on an under surface of the second flow passage member 6, and the piezoelectric actuator substrate 40 is disposed in a space formed by the opening 6*d*.

The opening 22*a* is provided on the under surface of the second flow passage member 6, and extends from the second direction D2 to the fifth direction D5. The opening 22*a* is formed on an edge, in the third direction D3, of the second flow passage member 6 so as to face toward the third direction D3 farther from the through hole 6*a*.

The opening 22*a* connects with the opening 6*b*, and forms the first integrated flow passage 22 when the opening 22*a* is sealed by the first flow passage member 4. The first integrated flow passage 22 is formed to extend from the second direction D2 to the fifth direction D5 to supply liquid to the openings 20*a* and the openings 28*c* of the first flow passage member 4.

The opening 26*a* is provided on the under surface of the second flow passage member 6, and extends from the second direction D2 to the fifth direction D5. The opening 26*a* is formed on another edge, in the sixth direction D6, of the second flow passage member 6 so as to face toward the sixth direction D6 farther from the through hole 6*a*.

The opening 26*a* connects with the opening 6*c*, and forms the second integrated flow passage 26 when the opening 26*a* is sealed by the first flow passage member 4. The second integrated flow passage 26 is formed to extend from the second direction D2 to the fifth direction D5 to supply liquid to the openings 24*a* and the openings 28*d* of the first flow passage member 4.

With a configuration described above, liquid supplied from the liquid tank to the opening 6*b* is supplied to the first integrated flow passage 22, and flows, via the opening 22*a*, into the first common flow passage 20 so that the liquid is supplied into the first flow passage member 4. And then the liquid collected through the second common flow passage 24 flows, via the opening 26*a*, into the second integrated flow passage 26 so that the liquid is collected externally via the opening 6*c*. Moreover, the second flow passage member 6 may not necessarily be provided.

As shown in FIGS. 5 to 8, the first flow passage member 4 is formed by laminating a plurality of plates 4*a* to 4*m*, and has, when viewed in a cross section in a lamination direction, the pressurizing chamber surface 4-1 provided on an upper side, and a discharge hole surface 4-2 provided on a lower side. On the pressurizing chamber surface 4-1, the piezoelectric actuator substrate 40 is disposed so that liquid is discharged from the discharge hole 8 opened on the discharge hole surface 4-2. A plurality of the plates 4*a* to 4*m* may each be formed of a metal, an alloy, or a resin. Moreover, the first flow passage member 4 may not be laminated with a plurality of the plates 4*a* to 4*m*, but may be integrally formed of a resin.

The first flow passage member 4 is formed with a plurality of the first common flow passages 20, a plurality of the second common flow passages 24, a plurality of edge flow passages 28, a plurality of the individual units 15, and a plurality of dummy individual units 17.

The first common flow passages 20 are provided to extend from the first direction D1 to the fourth direction D4, and formed to connects with the openings 20*a*. In addition, the first common flow passages 20 are arranged in multiple lines from the second direction D2 to the fifth direction D5.

The second common flow passages 24 are provided to extend from the fourth direction D4 to the first direction D1, and formed to communicate with the openings 24*a*. In addition, the second common flow passages 24 are arranged in multiple lines from the second direction D2 to the fifth direction D5, and disposed between the adjoining first common flow passages 20. Therefore, the first common flow passages 20 and the second common flow passages 24 are alternately disposed from the second direction D2 to the fifth direction D5.

The edge flow passages 28 are formed on both edges, in the second direction D2 and the fifth direction D5, of the first flow passage member 4. The edge flow passages 28 each have a wide section 28*a*, a narrow section 28*b*, and openings 28*c* and 28*d*. Liquid supplied from the opening 28*c* flows into each of the edge flow passages 28 in an order of the wide section 28*a*, the narrow section 28*b*, the wide section 28*a*, and the opening 28*d*. Therefore, the liquid is present in and flows into each of the edge flow passages 28 so as to unify a temperature around the edge flow passages 28 of the first flow passage member 4. Therefore, heat is less likely to be radiated from the edges, in the second direction D2 and the fifth direction D5, of the first flow passage member 4.

Figure 6:
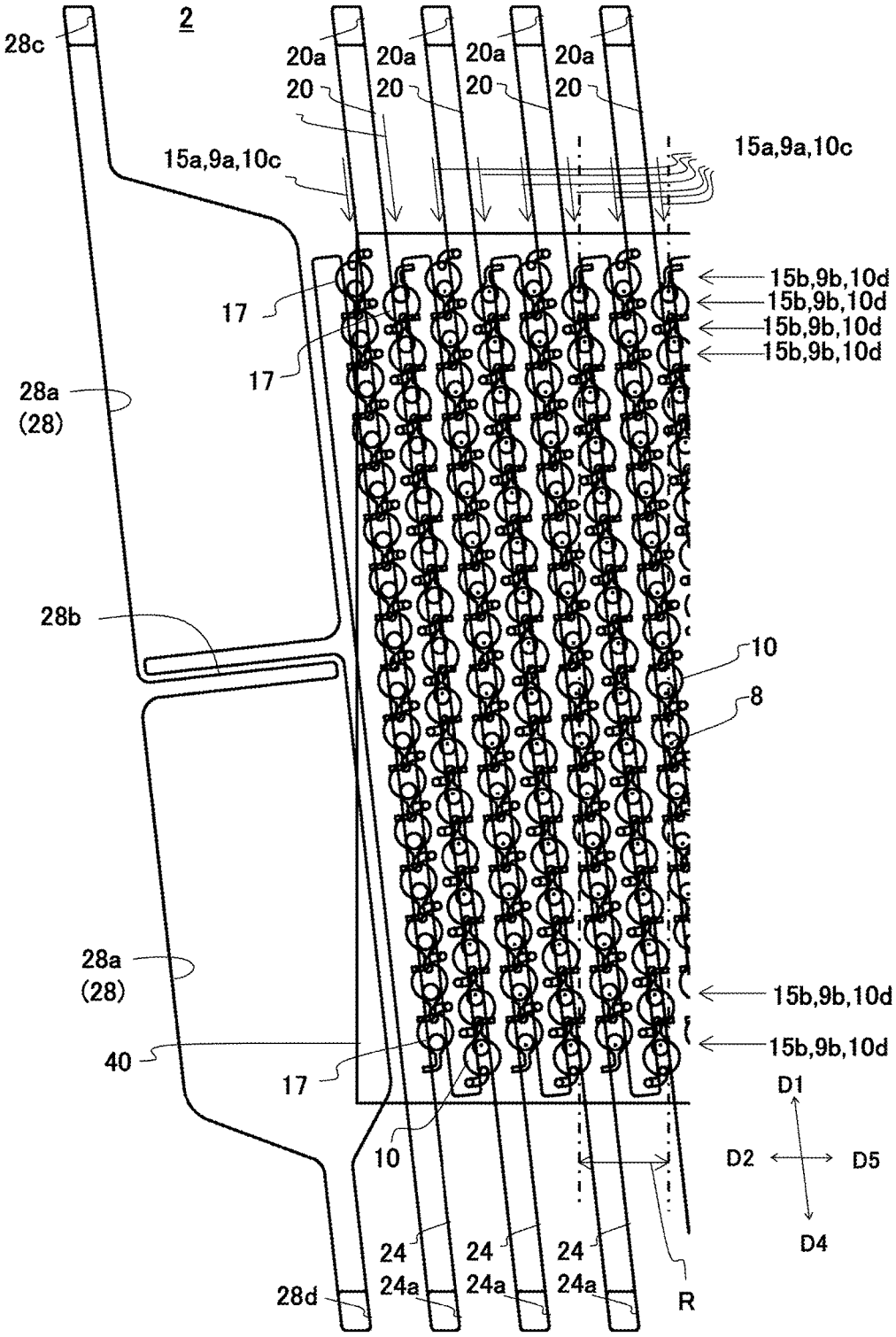
FIG. 6 is an enlarged plan view of a section of the head body as shown in FIG. 5.
Figure 7:
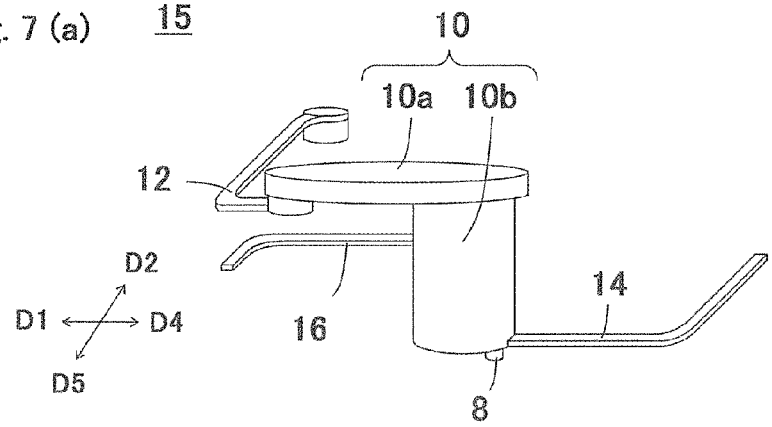
FIG. 7(*a*) is a perspective view of a discharge unit, FIG. 7(*b*) is a plan view of the discharge unit, and FIG. 7(*c*) is a plan view of an electrode disposed on the discharge unit.
Figure 7:
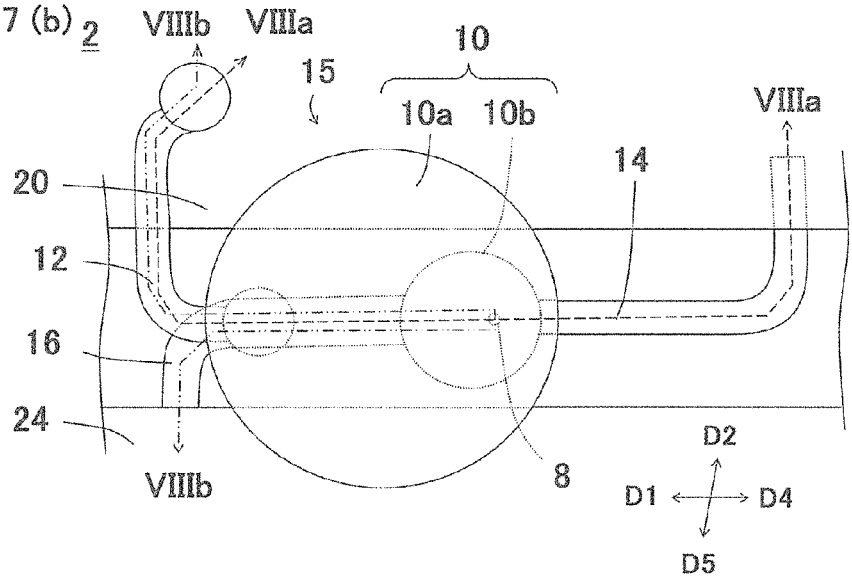
Figure 7:
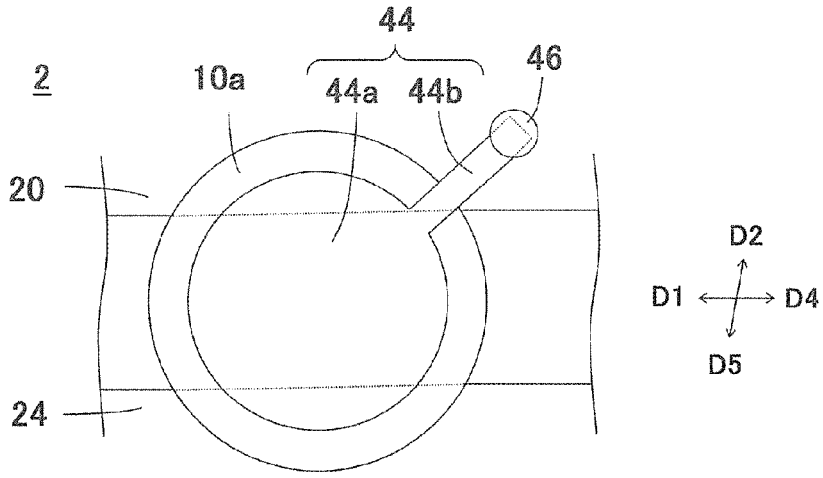

With reference to FIGS. 6 and 7, the discharge units 15 will now be described herein. The discharge units 15 each include the discharge hole 8, the pressurizing chamber 10, the first individual flow passage (first flow passage) 12, the second individual flow passage (fifth flow passage) 14, and the third individual flow passage (third flow passage) 16. Moreover, in the liquid discharge head 2, the liquid is supplied from the first individual flow passages 12 and the second individual flow passages 14 to the pressurizing chambers 10, and collected by the third individual flow passages 16 from the pressurizing chambers 10. Moreover, although details will be described later, a flow passage resistance in the third individual flow passages 16 is lower than flow passage resistances in the first individual flow passages 12 and the second individual flow passages 14.

The discharge units 15 are provided between the adjoining first common flow passages (second flow passages) 20 and the second common flow passages (fourth flow passages) 24, and are formed in a matrix shape in a surface direction of the first flow passage member 4. The discharge units 15 have discharge unit columns 15*a* and discharge unit lines 15*b*. The discharge unit columns 15*a* are arranged from the first direction D1 to the fourth direction D4. The discharge unit lines 15*b* are arranged from the second direction D2 to the fifth direction D5.

The pressurizing chambers 10 have pressurizing chamber columns 10*c* and pressurizing chamber lines 10*d*. In addition, the discharge holes 8 have discharge hole columns 9*a* and discharge hole lines 9*b*. The discharge hole columns 9*a* and the pressurizing chamber columns 10*c* are arranged in a similar manner from the first direction D1 to the fourth direction D4. In addition, the discharge hole lines 9*b* and the pressurizing chamber lines 10*d* are arranged in a similar manner from the second direction D2 to the fifth direction D5.

Angles between a line formed by the first direction D1 and the fourth direction D4 and a line formed by the second direction D2 and the fifth direction D5 are each offset from a right angle. Because of this, the discharge holes 8 belonging to the discharge hole columns 9*a* disposed in the first direction D1 are each other disposed by the offset from the right angle toward the second direction D2. And then, since the discharge hole columns 9*a* are disposed in parallel to the second direction D2, the discharge holes 8 belonging to the different discharge hole columns 9*a* are disposed by the offset toward the second direction D2. In combination of these offsets, the discharge holes 8 of the first flow passage member 4 are disposed at a predetermined interval in the second direction D2. Therefore, printing is possible to fill a predetermined region with a pixel formed by the discharged liquid.

In FIG. 6, when the discharge holes 8 are projected in the third direction D3 and the sixth direction D6, the thirty two (32) discharge holes 8 are projected in a region indicated by virtual straight lines R, and, within the virtual straight lines R, the discharge holes 8 each align at an interval of 360 dpi. Therefore, when the recording medium P is conveyed in a direction orthogonal to the virtual straight lines R for printing, printing is possible at a resolution of 360 dpi.

The dummy discharge units 17 are provided between a farthest one, in the second direction D2, of the first common flow passages 20 and a farthest one, in the second direction D2, of the second common flow passages 24. In addition, the dummy discharge units 17 are also provided between a farthest one, in the fifth direction D5, of the first common flow passages 20 and a farthest one, in the fifth direction D5, of the second common flow passages 24 (not shown). The dummy discharge units 17 are provided to stabilize the liquid discharged from a farthest one, in the second direction D2 or the fifth direction D5, of the discharge unit columns 15*a*.

The pressurizing chamber 10 has, as shown in FIGS. 7 and 8, a pressurizing chamber body 10*a* and a partial flow passage 10*b*. The pressurizing chamber body 10*a* forms a circular shape, when viewed in a plane, and the partial flow passage 10*b* extends downwardly from a center of the pressurizing chamber body 10*a*.

The pressurizing chamber body 10*a* is configured to accept pressure from the displacement element 48 disposed on the pressurizing chamber body 10*a* to pressurize liquid in the partial flow passage 10*b*.

The pressurizing chamber body 10*a* has an approximately disc shape in a side view of FIG. 7*a*, and a circular shape in the planar view of FIG. 7*b*. The circular shape can increase an amount of displacement, and therefore can increase a volumetric change caused by the displacement in each of the pressurizing chambers 10. The partial flow passage 10*b* has an approximately columnar shape having a diameter smaller than a diameter of the pressurizing chamber body 10*a*, and in the planar view shows a circular shape. In addition, the partial flow passage 10*b* is accommodated, inside the pressurizing chamber body 10*a* when viewed from the pressurizing chamber surface 4-1.

Moreover, the partial flow passage 10*b* may have a conical shape or a truncated conical shape where a cross-sectional area decreases toward the discharge hole 8. Therefore, widths between the first common flow passages 20 and the second common flow passages 24 can be increased to reduce a difference in pressure loss.

The pressurizing chambers 10 are disposed along both sides of each of the first common flow passages 20 to configure the pressurizing chamber columns 10*c*, one column on each side, two columns in total. The first common flow passages 20 and the pressurizing chambers 10 disposed in parallel on both sides of each of the first common flow passages 20 are connected via the first individual flow passages 12 and the second individual flow passages 14.

In addition, the pressurizing chambers 10 are disposed along both sides of each of the second common flow passages 24 to configure the pressurizing chamber columns 10*c*, one column on each side, two columns in total. The second common flow passages 24 and the pressurizing chambers 10 disposed in parallel on both sides of each of the second common flow passages 24 are connected via the third individual flow passages 16.

With reference to FIG. 7, the first individual flow passages 12, the second individual flow passages 14, and the third individual flow passages 16 will now be described herein.

The first individual flow passages 12 each connect each of the first common flow passages 20 and the pressurizing chamber body 10*a*. After extended upwardly from upper surfaces of the first common flow passages 20, the first individual flow passages 12 each extend toward the fifth direction D5, extend toward the fourth direction D4, extend again upwardly, and are each connected to an under surface of the pressurizing chamber body 10*a*.

The second individual flow passages 14 each connect each of the first common flow passages 20 and the partial flow passage 10*b*. After extended from under surfaces of the first common flow passages 20 toward the fifth direction D5, and then extended toward the first direction D1, the second individual flow passages 14 are each connected to a side surface of the partial flow passage 10*b*.

The third individual flow passages 16 each connect each of the second common flow passages 24 and the partial flow passage 10*b*. After extended from side surfaces of the second common flow passages 24 toward the second direction D2, and then extended toward the fourth direction D4, the third individual flow passages 16 are each connected to the side surface of the partial flow passage 10*b*.

The flow passages are configured such that a flow passage resistance in the third individual flow passages 16 is lower than flow passage resistances in the first individual flow passages 12 and the second individual flow passages 14. To lower the flow passage resistance in the third individual flow passages 16 than the flow passage resistances in the first individual flow passages 12 and the second individual flow passages 14, for example, a thickness of the plate 4*f* by which the third individual flow passages 16 are formed may be set larger than a thickness of the plate 4*c* by which the first individual flow passages 12 are formed and a thickness of the plate 4*l* by which the second individual flow passages 14 are formed. In addition, when viewed in a plane, widths of the third individual flow passages 16 may be greater than widths of the first individual flow passages 12 and widths of the second individual flow passages 14. In addition, when viewed in a plane, lengths of the third individual flow passages 16 may be less than lengths of the first individual flow passages 12 and lengths of the second individual flow passages 14.

With a configuration described above, in the first flow passage member 4, the supplied liquid flows, via the openings 20*a*, to the first common flow passages 20, and then via the first individual flow passages 12 and the second individual flow passages 14, into the pressurizing chambers 10, and is partially discharged from the discharge holes 8. And then the remaining liquid flows from the pressurizing chambers 10, via the third individual flow passages 16, to the second common flow passages 24, and then is discharged from the first flow passage member 4, via the openings 24*a*, to the second flow passage member 6.

With reference to FIG. 8, the piezoelectric actuator substrate 40 will now be described herein. On an upper surface of the first flow passage member 4, the piezoelectric actuator substrate 40 including the displacement elements 48 is joined so that the displacement elements 48 are disposed in position on the pressurizing chambers 10. The piezoelectric actuator substrate 40 occupies a region having a shape approximately identical to a shape of a pressurizing chamber group formed with the pressurizing chambers 10. In addition, an opening of each of the pressurizing chambers 10 closes when the piezoelectric actuator substrate 40 is joined onto the pressurizing chamber surface 4-1 of the first flow passage member 4.

The piezoelectric actuator substrate 40 has a structure laminated with two piezoelectric ceramic layers 40*a* and 40*b* each including a piezoelectric material. The piezoelectric ceramic layers 40*a* and 40*b* each have a thickness of approximately 20 μm. Both the piezoelectric ceramic layers 40*a* and 40*b* extend over a plurality of the pressurizing chambers 10.

The piezoelectric ceramic layers 40*a* and 40*b* include, for example, a ceramic material having ferroelectricity, such as lead zirconate titanate (PZT) type, $NaNbO_3$ type, $BaTiO_3$ type, $(BiNa)NbO_3$ type, and $BiNaNb_5O_{15}$ type. Moreover, the piezoelectric ceramic layer 40*b* functions as a vibrating plate, and does not necessarily include a piezoelectric material, but may use a ceramic layer other than piezoelectric material and a metal plate.

The piezoelectric actuator substrate 40 is formed with a common electrode 42, individual electrodes 44, and connection electrodes 46. The common electrode 42 is formed approximately entirely in a surface direction on a region between the piezoelectric ceramic layer 40*a* and the piezoelectric ceramic layer 40*b*. In addition, the individual electrodes 44 are respectively disposed at positions on an upper surface of the piezoelectric actuator substrate 40 so as to face the pressurizing chambers 10.

Portions interposed between the individual electrodes 44 and the common electrode 42 of the piezoelectric ceramic layer 40*a* are polarized in a thickness direction so as to form the displacement elements 48 each having a unimorph structure that is displaced when a voltage is applied onto the individual electrodes 44. Accordingly, the piezoelectric actuator substrate 40 has a plurality of the displacement elements 48.

The common electrode 42 can be formed of a metallic material such as Ag—Pd type, and a thickness of the common electrode 42 may be approximately 2 μm. The common electrode 42 has a surface electrode (not shown) for the common electrode 42 on the piezoelectric ceramic layer 40*a*, and the surface electrode for the common electrode 42 is connected to the common electrode 42 via a via hole formed when the surface electrode for the common electrode 42 penetrates into the piezoelectric ceramic layer 40*a*, and is grounded so that a ground potential is retained.

The individual electrodes 44 are each formed of a metallic material such as Au type, and each have an individual electrode body 44*a* and an extraction electrode 44*b*. As shown in FIG. 7(*c*), the individual electrode body 44*a* is formed in an approximately circular shape when viewed in a plane, and is formed smaller than the pressurizing chamber body 10*a*. The extraction electrode 44*b* extends from the individual electrode body 44*a*, and, onto the extended extraction electrode 44*b*, to where the connection electrodes 46 are formed.

The connection electrodes 46 include, for example, silver-palladium including glass frit, and are each formed protrudingly with a thickness of approximately 15 μm. The connection electrodes 46 are electrically joined to electrodes provided to the signal transmission sections 60.

The liquid discharge head 2 causes the displacement elements 48 to displace, through a control by the control section 76 via the driver ICs 62 and other devices, in accordance with a drive signal supplied to the individual electrodes 44. As a driving method, a so-called pull driving method can be used.

With reference to FIG. 8(*b*), a damper 30 will now be described in detail.

The damper 30 is formed in each of the second common flow passages 24 of the first flow passage member 4, and, via the damper 30, a space 32 faces each of the second common flow passages 24. The damper 30 includes a first damper 30*a* and a second damper 30*b*. The space 32 includes a first space 32*a* and a second space 32*b*. The first space 32*a* is provided, with the first damper 30*a* interposed, above each of the second common flow passages 24 into which liquid flows. The second space 32*b* is provided, with the first damper 30*b* interposed, under each of the second common flow passages 24 into which the liquid flows.

The first damper 30*a* is formed approximately entirely over each of the second common flow passages 24. Therefore, when viewed in a plane, the first damper 30*a* has a shape identical to a shape of each of the second common flow passages 24. In addition, the first space 32*a* is formed approximately entirely over the first damper 30*a*. Therefore, when viewed in a plane, the first space 32*a* has a shape identical to the shape of each of the second common flow passages 24.

The second damper 30*b* is formed approximately entirely under each of the second common flow passages 24. Therefore, when viewed in a plane, the second damper 30*b* has a shape identical to a shape of each of the second common flow passages 24. In addition, the second space 32*b* is formed approximately entirely under the second damper 30*b*. Therefore, when viewed in a plane, the second space 32*b* has a shape identical to the shape of each of the second common flow passages 24.

The first damper 30*a* and the first space 32*a* can be formed by forming grooves through half etching on the plates 4*d* and 4*e*, and joining the plates 4*d* and 4*e* so that the grooves face each other. At this time, a portion of the plate 4*e*, remaining after half etching, becomes the first damper 30*a*. The second damper 30*b* and the second space 32*b* can be produced in a similar manner by forming grooves through half etching on the plates 4*k* and 4*l*.

When each of the pressurizing chambers 10 is pressurized, a pressure wave transmits from the pressurizing chamber body 10*a* to the discharge hole 8, thus the liquid discharge head 2 discharges the liquid from the discharge hole 8. At that time, due to a partial transmission of a pressure wave generated in the pressurizing chamber body 10*a* to the second individual flow passage 14 positioned between the pressurizing chamber body 10*a* and the discharge hole 8, a pressure is likely to propagate into the first common flow passage 20. Similarly, due to a partial transmission of a pressure wave generated in the pressurizing chamber body 10*a* to the third individual flow passage 16 positioned between the pressurizing chamber body 10*a* and the discharge hole 8, a pressure is likely to propagate into the second common flow passage 24.

If a pressure propagates into the first common flow passage 20 and the second common flow passage 24, the pressure is likely to propagate, via the second individual flow passage 14 and the third individual flow passage 16 connected to the other discharge units 15, into the pressurizing chambers 10 of the other discharge units 15. Thus, a fluid crosstalk is likely to occur.

In response to this, the liquid discharge head 2 is configured so that a flow passage resistance in the third individual flow passages 16 is lower than a flow passage resistance in the second individual flow passages 14. Therefore, part of a pressure wave generated in the pressurizing chamber body 10*a* can easily pressure-propagate, via the third individual flow passage 16 having a flow passage resistance that is lower than a flow passage resistance in the second individual flow passage 14, into the second common flow passages 24. Therefore, the liquid discharge head 2 is configured so that a pressure easily propagates into the second common flow passages 24, but a pressure is difficult to propagate into the first common flow passages 20.

The damper 30 formed in each of the second common flow passages 24 can attenuate a pressure in each of the second common flow passages 24. As a result, a pressure can be prevented as much as possible from being propagated from the second common flow passages 24 to the other third individual flow passages 16, thus a fluid crosstalk can be reduced.

A flow passage resistance in the third individual flow passages 16 can be, for example, 15 to 30 times lower than a flow passage resistance in the second individual flow passages 14. Therefore, a pressure can be prevented as much as possible from being propagated into the second individual flow passages 14. In addition, a flow passage resistance in the third individual flow passages 16 can be, for example, 15 to 30 times lower than a flow passage resistance in the first individual flow passages 12. Therefore, a pressure can be prevented as much as possible from being propagated into the first individual flow passages 12.

In addition, due to a partial transmission of a pressure wave from the pressurizing chamber body 10*a* to the first individual flow passage 1, a pressure is likely to propagate into the first common flow passage 20. Therefore, a desired pressure is not applied to the pressurizing chamber body 10*a*, thus an amount of liquid to be discharged becomes insufficient.

In response to this, the liquid discharge head 2 is configured so that a flow passage resistance in the third individual flow passages 16 is lower than flow passage resistances in the first individual flow passages 12 and the second individual flow passages 14. This configuration prevents as much as possible a pressure wave generated in the pressurizing chamber body 10*a* from being partially pressure-propagated into the first individual flow passage 12 and the second individual flow passage 14. As a result, a pressure wave applied to the pressurizing chamber body 10*a* pressure-propagates toward the discharge hole 8 to prevent, as much as possible, an amount of liquid to be discharged from being reduced.

In addition, in the first flow passage member 4, a first damper 30*a* is provided above each of the second common flow passages 24, while a second damper 30*b* is provided under each of the second common flow passages 24. That is, the first damper 30*a* is formed on an upper surface configuring each of the second common flow passages 24, while the second damper 30*b* is formed on an under surface configuring each of the second common flow passages 24.

Therefore, as the first damper 30*a* and the second damper 30*b* deform, a fluctuating pressure in each of the second common flow passages 24 can be absorbed to attenuate the pressure in each of the second common flow passages 24. As a result, the pressure can be prevented, as much as possible, from being propagated backwardly from the second common flow passages 24 to the third individual flow passages 16 to reduce a fluid crosstalk.

Moreover, the damper 30 may not necessarily include the first damper 30*a* and the second damper 30*b*. The damper 30 may include only the first damper 30*a*, or may only include the second damper 30*b*.

In addition, when viewed in a plane, the third individual flow passages 16 are respectively connected to side surfaces, facing the second direction D2, of the second common flow passages 24. In other words, the third individual flow passages 16 respectively extend from the side surfaces, facing the second direction D2, of the second common flow passages 24 toward the second direction D2, extend toward the fourth direction D4, and are connected to side surfaces, facing the first direction D1, of the partial flow passages 10*b*.

Therefore, the third individual flow passages 16 can extend toward a surface direction, i.e. a direction toward which the plate 4*f* expands to secure spaces for providing the spaces 32 above and under each of the second common flow passages 24. As a result, the first damper 30*a* can be provided on the upper surface of each of the second common flow passages 24, while the second damper 30*b* can be provided on the under surface of each of the second common flow passages 24, so that a pressure can effectively be attenuated in the second common flow passages 24.

In addition, the third individual flow passages 16 are each connected, on a side facing the pressurizing chamber body 10*a*, to each of the second common flow passages 24. As a result, even if an air bubble enters from the discharge port 8 into the partial flow passage 10*b*, the air bubble can exit from the third individual flow passage 16 by its buoyancy. Therefore, the air bubble can be prevented as much as possible from being stagnated in the partial flow passage 10*b*, thus pressure propagation to the liquid can be prevented as much as possible from being negatively affected.

Moreover, the side surface of each of the second common flow passages 24, which faces the pressurizing chamber body 10*a*, is a portion, on the side surface of each of the second common flow passages 24, positioned above a center in a lamination direction of the plates 4*a* to 4*m*.

In addition, it is preferable that an upper surface of each of the third individual flow passages 16 and the upper surface of each of the second common flow passages 24 are formed flush. Therefore, the air bubble discharged from the partial flow passage 10*b* flows along the upper surface of each of the third individual flow passages 16 and the upper surface of each of the second common flow passages 24, thus the air bubble can further easily exit externally.

In addition, as shown in FIG. 6, when viewed in a plane, the pressurizing chambers 10 are each disposed between each of the first common flow passages 20 and the second common flow passages 24, and part of each of the pressurizing chambers 10 is disposed on each of the second common flow passages 24. Therefore, when viewed in a plane, a part of each of the pressurizing chambers 10 is disposed on the first damper 30*a* so that the displacement element 48 (see FIG. 8) is disposed on the first damper 30*a*.

As a result, a vibration generated when the displacement element 48 is driven can be prevented as much as possible from being propagated into each of the second common flow passages 24. That is, a vibration of the displacement element 48 is reduced by the first damper 30*a*, and is less likely to propagate into each of the second common flow passages 24.

Figure 9:
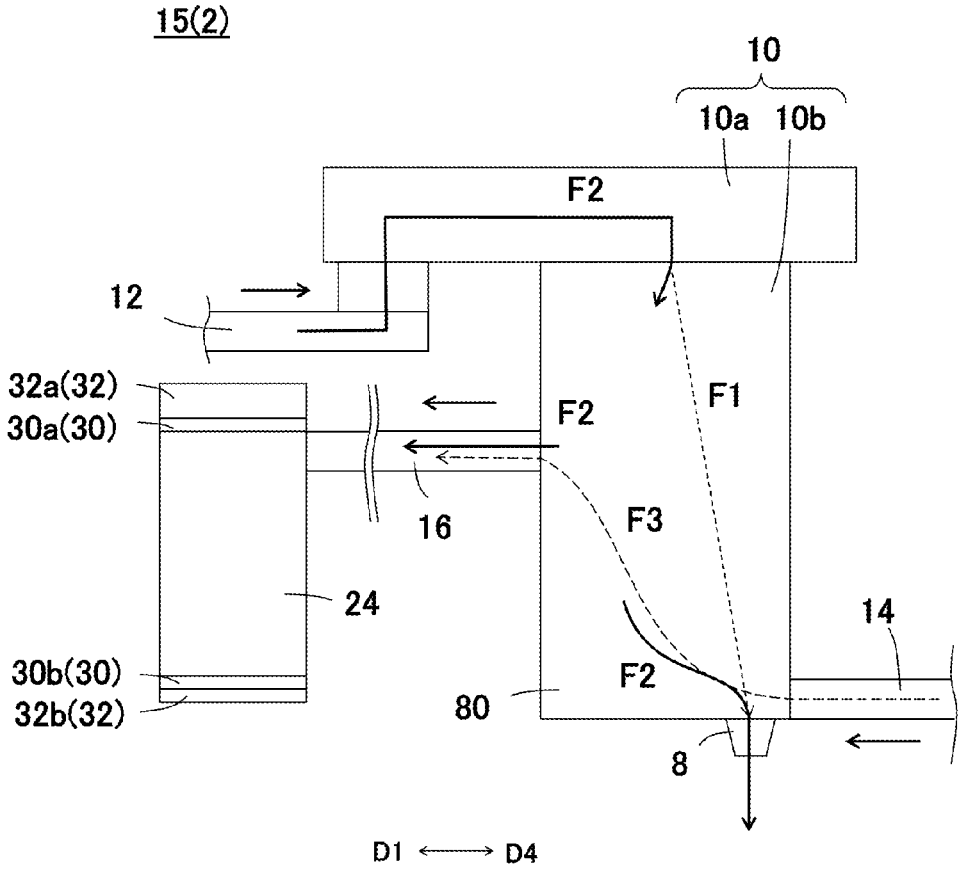
FIG. 9 is a schematic view illustrating a flow of a fluid in a liquid discharge unit.

With reference to FIG. 9, liquid flowing into each of the discharge units 15 will now be described herein in detail. Moreover, in FIG. 9, an actual flow of liquid is rendered with a solid line F2, a conventional flow of liquid is rendered with a broken line F1, and a flow of liquid supplied from the second individual flow passage 14 is rendered with a long broken line F3.

In the discharge unit 15, the liquid is supplied from the first individual flow passage 12 and the second individual flow passage 14, and the liquid that is not discharged is collected from the third individual flow passage 16.

The liquid supplied from the first individual flow passage 12 passes into the pressurizing chamber body 10*a* to flow downwardly into the partial flow passage 10*b*, and is partially discharged from the discharge hole 8. The liquid that is not discharged from the discharge hole 8 is collected, via the third individual flow passage 16, outside the discharge unit 15.

The liquid supplied from the second individual flow passage 14 is partially discharged from the discharge hole 8. The liquid that is not discharged from the discharge hole 8 flows upwardly into the partial flow passage 10*b*, and is collected, via the third individual flow passage 16, outside the discharge unit 15.

The liquid supplied from the first individual flow passage 12 flows into the pressurizing chamber body 10*a* and the partial flow passage 10*b*, and is discharged from the discharge hole 8. When the second individual flow passage 14 is not connected, the liquid flows evenly, as shown with the broken line, from a center of the pressurizing chamber body 10*a* to the discharge hole 8.

Such a flow forms a configuration where, in the partial flow passage 10*b*, the liquid is difficult to flow around a region 80 positioned opposite to an outlet of the second individual flow passage 14, thus, for example, the liquid is likely to stagnate around the region 80.

In response to this, the first flow passage member 4 includes the first individual flow passages 12 connected to the pressurizing chamber bodies 10*a*, and the second individual flow passages 14 connected on under sides of the partial flow passages 10*b*, to which the discharge holes 8 are positioned, to supply liquid toward sides of the partial flow passages 10*b*.

Therefore, the liquid flowing from the pressurizing chamber body 10*a* to the discharge hole 8 and the liquid flowing from the second individual flow passage 14 to the partial flow passage 10*b* can collide. Therefore, the liquid can be prevented, as much as possible, from evenly flowing from the pressurizing chamber body 10*a* to the discharge hole 8. Thus, the liquid can be prevented, as much as possible, from being stagnated in the partial flow passage 10*b*.

That is, a position of a point, at which the liquid stagnates when the liquid supplied from the pressurizing chamber body 10*a* to the discharge hole 8, changes due to a collision with the liquid flowing from the pressurizing chamber body 10*a* to the discharge hole 8. Thus, the liquid can be prevented, as much as possible, from being stagnated in the partial flow passage 10*b*.

Figure 10:
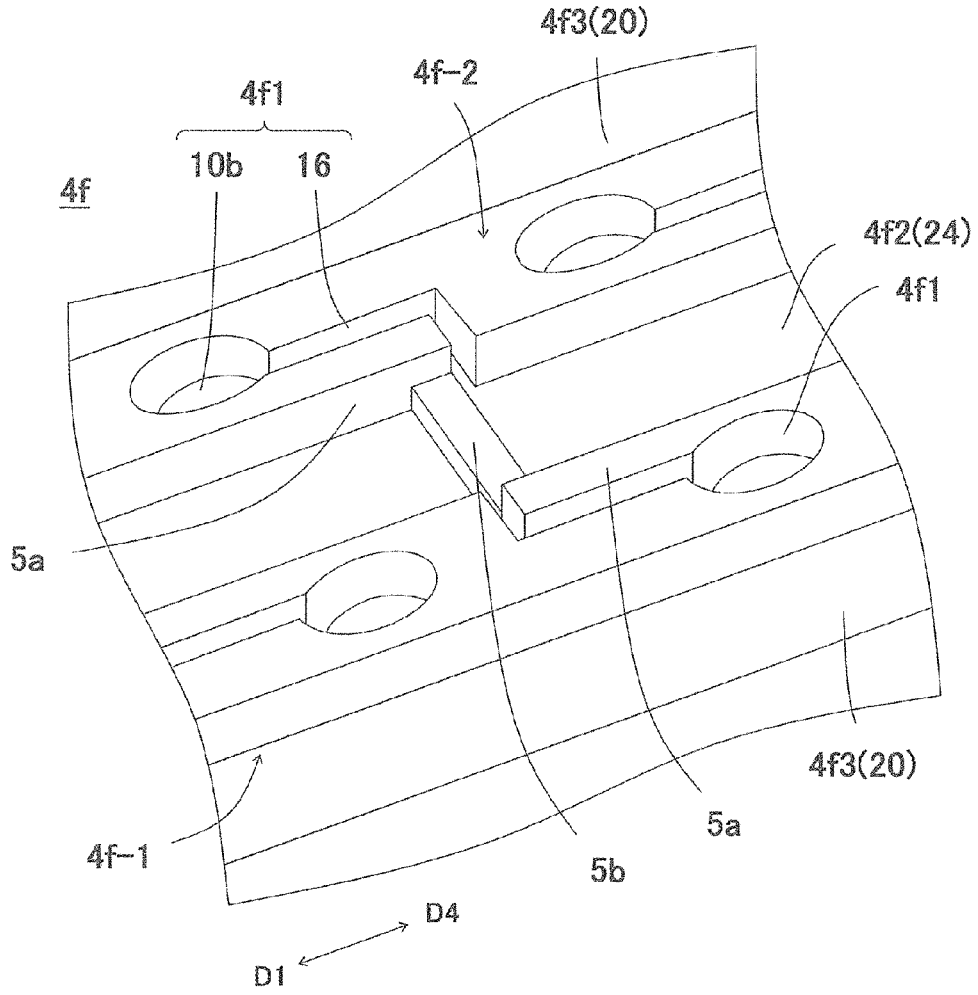
FIG. 10 is an enlarged perspective view of part of a plate forming a first flow passage member.

With reference to FIG. 10, the plate 4*f* forming the third individual flow passages 16 will now be described herein. The plate 4*f* includes a first surface 4*f*-1 facing the pressurizing chamber surface 4-1 (see FIG. 8) and a second surface **4*f*-2 facing the discharge hole surface 4-2 (see FIG. 8). In addition, the plate 4*f* further includes a plurality of first holes 4*f*1 forming the third individual flow passages 16, a plurality of second holes 4*f*2 forming the second common flow passages 24, a plurality of third holes 4*f*3 forming the first common flow passages 20, and a plurality of partition walls 5*a* each disposed between each of the first holes 4*f*1 and each of the second holes 4*f*2. The first holes 4*f*1 are disposed on both sides of each of the second holes 4*f*2**.

The partition walls **5*a* are each provided per each of the discharge units 15 to divide the first holes 4*f*1 and the second holes 4*f*2. The plate 4*f* further includes connection sections 5*b* connecting the partition walls 5*a* facing each other via each of the second common flow passages 24**.

The first holes **4*f*1 pass through the plate 4*f* to form the partial flow passages 10*b* and the third individual flow passages 16. Therefore, the first holes 4*f*1 are formed in the plate 4*f* in a matrix shape. The second holes 4*f*2 pass through the plate 4*f* to form the second common flow passages 24. The third holes 4*f*3 pass through the plate 4*f* to form the first common flow passages 20**.

The plate **4*f* further includes the connection sections 5*b* connecting the partition walls 5*a* facing each other via each of the second holes 4*f*2. Therefore, rigidity of the partition walls 5*a* can be increased to prevent as much as possible the partition walls 5*a* from being deformed. As a result, shapes of the first holes 4*f*1 can be kept stable to keep almost uniform shapes of the third individual flow passages 16 of the discharge units 15. Therefore, liquid discharged from the discharge units 15** can be kept almost uniform.

In addition, thicknesses of the connection sections **5*b* are thinner than a thickness of the plate 4*f*. Therefore, the second common flow passages 24 can be prevented as much as possible from being reduced in volume. As a result, a flow passage resistance in the second common flow passages 24 can be prevented as much as possible from being reduced. Moreover, the connection sections 5*b* can be formed by half etching the first surface 4*f*-1**.

Second Embodiment

Figure 11:
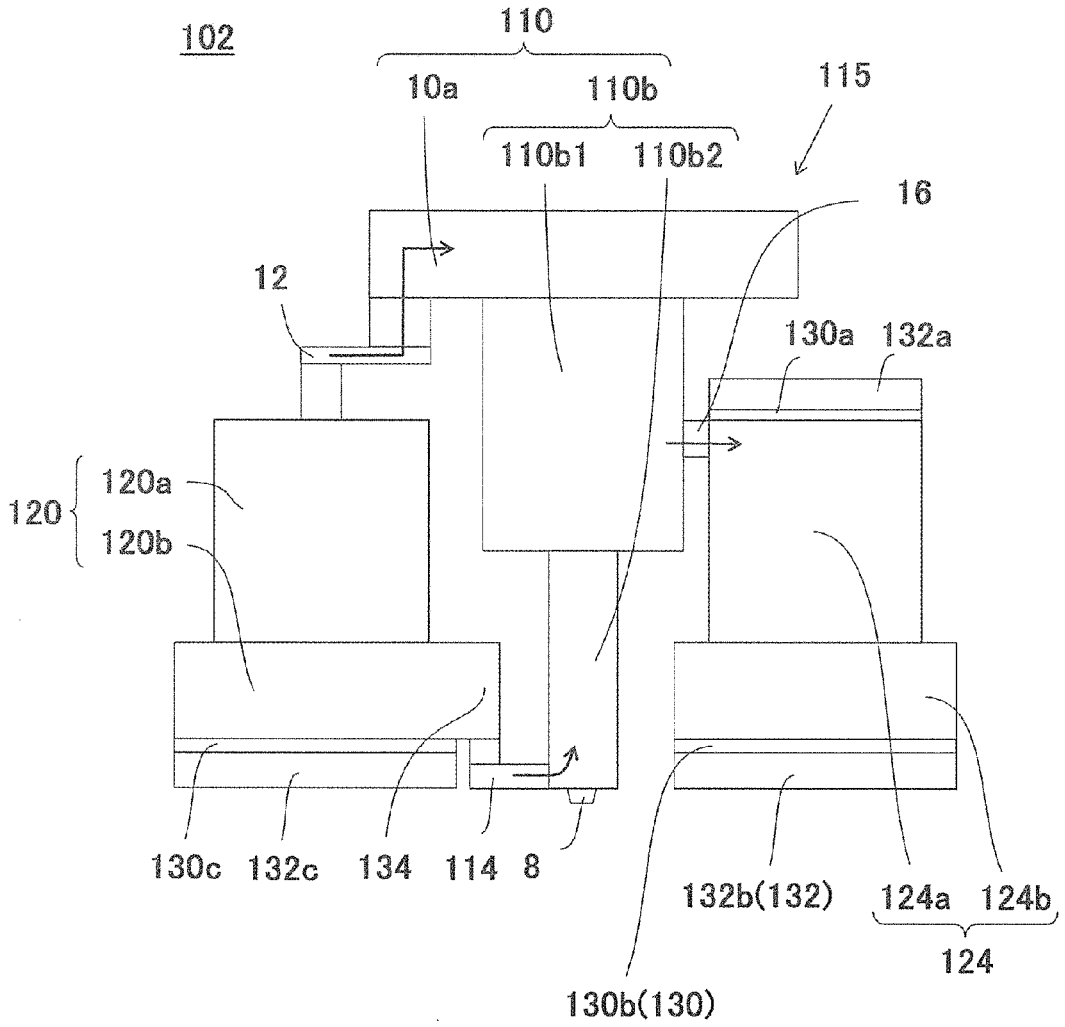
FIG. 11 is a schematic view of a liquid discharge head according to a second embodiment of the present invention, in which connections of flow passages are illustrated.
Figure 12:
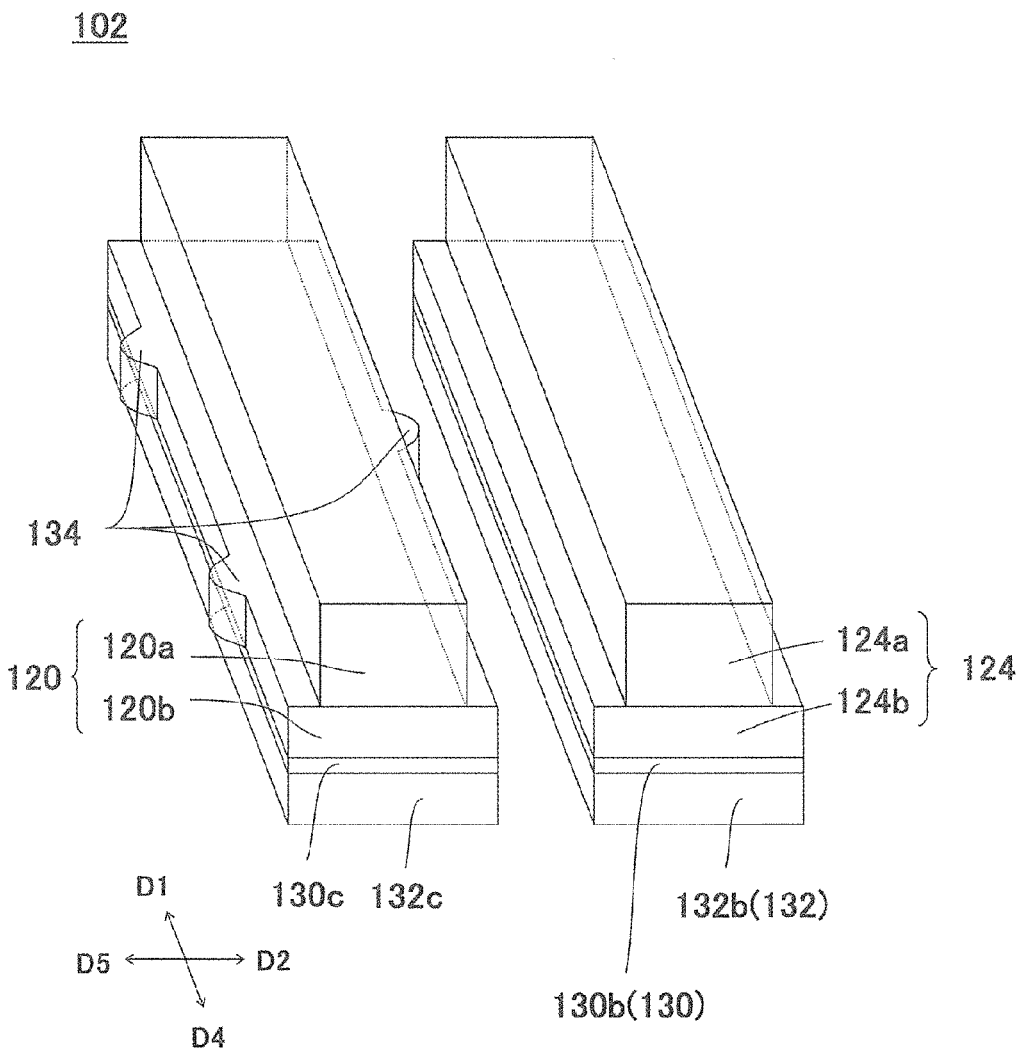
FIG. 12 is a schematic perspective view of the liquid discharge head according to the second embodiment of the present invention, in which a second flow passage and a fourth flow passage are enlarged.

With reference to FIGS. 11 and 12, a liquid discharge head 102 according to a second embodiment will now be described herein. In the liquid discharge head 102, a configuration of discharge units 115, first common flow passages 120, second common flow passages 124, dampers 130, and spaces 132 differs from a configuration of the liquid discharge head 2. Moreover, identical members are applied hereinafter with identical reference characters. In addition, in FIG. 11, a flow of liquid is rendered with a solid line, and, in FIG. 12, a first damper **130*a* and a first space 132*a*, as shown in FIG. 11**, are omitted.

The discharge units 115 each include a pressurizing chamber 110, the discharge hole 8, the first individual flow passage 12, a second individual flow passage 114, and the third individual flow passage 16. The pressurizing chamber 110 includes the pressurizing chamber body **10*a* and a partial flow passage 110*b***.

The partial flow passage **110*b* includes a wide section 110*b*1 and a narrow section 110*b*2. The narrow section 110*b*2 is disposed closer, than the wide section 110*b*1, to the discharge hole 8. When viewed in a cross section, the narrow section 110*b*2 is smaller in width than the wide section 110*b*1. In other words, a cross-sectional area, in a direction orthogonal to a thickness direction, of the narrow section 110*b*2 is smaller than a cross-sectional area, in a direction orthogonal to a thickness direction, of the wide section 110*b*1. A diameter of the narrow section 110*b*2 may be 35 to 75% of a diameter of the wide section 110*b*1**.

The second common flow passages 124 each include a first portion **124*a* and a second portion 124*b*. The second portion 124*b* is disposed closer, than the first portion 124*a*, to the discharge hole 8. The second portion 124*b* is formed, when viewed in a cross section, wider in width than the first portion 124*a*. A width of the second portion 124*b* may be 1.1 to 1.5 times a width of the first portion 124*a***.

The first common flow passages 120 each include a third portion **120*a* and a fourth portion 120*b*. The fourth portion 120*b* is disposed closer, than the third portion 120*a*, to the discharge hole 8. The fourth portion 120*b* is formed, when viewed in a cross section, wider in width than the third portion 120*a*. A width of the fourth portion 120*b* may be 1.1 to 1.5 times a width of the third portion 120*a***.

In addition, in each of the first common flow passages 120, a protruded section 134 is formed on the fourth portion **120*b*. The protruded section 134 is formed to extend from the fourth portion 120*b* in the second direction D2 or the fifth direction D5. Under the protruded section 134, the second individual flow passage 114 is connected. A protrusion length of the protruded section 134** may be in a range from 0.1 to 0.5 mm.

The dampers 130 each include the first damper **130*a*, a second damper 130*b*, and a third damper 130*c*. The spaces 132 each include a first space 132*a*, a second space 132*b*, and a third space 132*c*. The first damper 130*a* and the second damper 130*b* are disposed to face each of the second common flow passages 124 in which liquid flows. The third damper 130*c* is disposed to face each of the first common flow passages 120** in which the liquid flows.

As shown in FIG. 12, the second damper **130*b* is disposed to face the second portion 124*b* of each of the second common flow passages 124, and, when viewed in a cross section, has an area approximately identical to an area of the second portion 124*b*. In addition, although not shown in the drawing, the first damper 130*a* is disposed to face the first portion 124*a* of each of the second common flow passages 124, and, when viewed in a cross section, has an area approximately identical to an area of the first portion 124*a***.

When viewed in a cross section, a width of the second damper **130*b* is greater than a width of the first damper 130*a*. Therefore, a cross-sectional area of the second damper 130*b* can be increased to effectively attenuate a pressure wave entered into each of the second common flow passages 124**.

The partial flow passage **110*b* includes the wide section 110*b*1 and the narrow section 110*b*2. In a space positioned under the wide section 110*b*1, the second portion 124*b* of each of the second common flow passages 124 and the fourth portion 120*b* of each of the first common flow passages 120 are disposed. Therefore, volumes of the fourth portion 120*b* of each of the first common flow passages 120 and the second portion 124*b* of each of the second common flow passages 124 can be increased to reduce flow passage resistances in the first common flow passages 120 and the second common flow passages 124**.

The third damper **130*c* is provided to each of the first common flow passages 120. Therefore, a pressure wave entered into each of the first common flow passages 120** can effectively be attenuated.

The protruded section 134 is formed on the fourth portion **120*b* of each of the first common flow passages 120. Under the protruded section 134, the second individual flow passage 114 is connected. The second individual flow passage 114 is connected to the narrow section 110*b*2 of the partial flow passage 110***b*. Therefore, while the third damper 130*c* is formed under each of the first common flow passages 120, the first common flow passages 120 and the discharge units 115 can respectively be connected.

That is, since the protruded section 134 extends into a region where the third damper 130*c* is not provided, the second individual flow passage 114 can bypass the third damper 130*c* and extend from an under surface of the protruded section 134. As a result, while the third damper 130*c* having a larger area is formed in each of the first common flow passages 120, the first common flow passages 120 and the discharge units 115 can respectively be connected.

In addition, when viewed in a cross section, a width of the third damper 130*c* is wider than the width of the third portion 120*a*, but narrower than the width of the fourth portion 120*b*. Therefore, while keeping an ability to attenuate a pressure wave propagated into the first common flow passages 120, the second individual flow passage 114 can extend under the fourth portion 120*b*.

Moreover, the width of the third portion 120*a* when viewed in a cross section represents a length of the third portion 120*a* when viewed in a cross section in a direction orthogonal to the first direction D1 and the fourth direction D4. This can also be applied to the width of the third damper 130*c*. In addition, the width of the fourth portion 120*b* when viewed in a cross section represents a length of the fourth portion 120*b* when viewed in a cross section in a direction orthogonal to the first direction D1 and the fourth direction D4, and represents the width of the fourth portion 120*b* excluding the protruded section 134.

Moreover, the third damper 130*c* may be provided above each of the first common flow passages 120, or may be provided above and under each of the first common flow passages 120.

Third Embodiment

Figure 13:
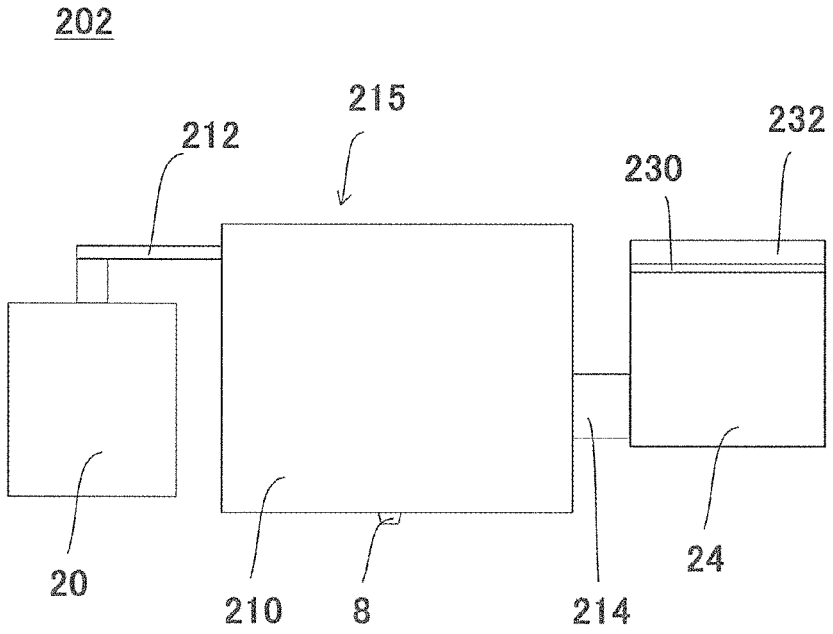
FIG. 13 is a schematic view of a liquid discharge head according to a third embodiment of the present invention.

With reference to FIG. 13, a liquid discharge head 202 according to a third embodiment will now be described herein.

The liquid discharge head 202 includes the first common flow passages 20, the second common flow passages 24, and discharge units 215. The discharge units 215 each include, the discharge hole 8, a pressurizing chamber 210, a first individual flow passage 212, and a second individual flow passage 214.

The first individual flow passage 212 connects each of the first common flow passages 20 and the pressurizing chamber 210. The second individual flow passage 214 connects each of the second common flow passages 24 and the pressurizing chamber 210. A flow passage resistance in the second individual flow passage 214 is lower than a flow passage resistance in the first individual flow passage 212.

Above each of the second common flow passages 24, a space 232 is provided with a damper 230 interposed. That is, the damper 230 is provided on an upper surface of each of the second common flow passages 24 into which liquid flows.

The liquid discharge head 202 is configured so that a flow passage resistance in the second individual flow passage 214 is lower than a flow passage resistance in the first individual flow passage 212. Therefore, part of a pressure wave generated in the pressurizing chamber 210 can easily pressure-propagate, via the second individual flow passage 214 having a flow passage resistance that is lower than a flow passage resistance in the first individual flow passage 212, into the second common flow passages 24. Therefore, the liquid discharge head 2 is configured so that pressure easily propagates into the second common flow passages 24, but the pressure is difficult to propagate into the first common flow passages 20.

The damper 230 formed in each of the second common flow passages 24 can attenuate the pressure in each of the second common flow passages 24. As a result, the pressure can be prevented as much as possible from being propagated backwardly from the second common flow passages 24 to the second individual flow passages 214, thus a fluid cross-talk can be reduced.

Although the first to third embodiments have been described above, the present invention should not be limited to the above described embodiments, but may be variously changed without departing from the scope of the present invention.

For example, as the pressurizing section, the pressurizing chamber 10 is pressurized through a piezoelectric deformation of a piezoelectric actuator, but the pressurizing section is not limited to this example. For example, a pressurizing section may provide a heating section per each of the pressurizing chambers 10 to heat liquid in the pressurizing chambers 10 with the heating sections to pressurize the liquid through thermal expansion.

In addition, although a configuration where, in the liquid discharge head 2, liquid is supplied from the first individual flow passages 12 and the second individual flow passages 14 to the pressurizing chambers 10, and is collected from the third individual flow passages 16, has been described, the present invention is not limited to this configuration. For example, a configuration may be applied, where liquid is supplied from the second individual flow passages 14 and the third individual flow passages 16 to the pressurizing chambers 10, and collected from the first individual flow passages 12.

That is, a configuration may be applied, where liquid is supplied from the second individual flow passages 14 and the third individual flow passage 16 to the partial flow passages 10*b*, flows upwardly in the partial flow passages 10*b*, and supplied to the pressurizing chamber bodies 10*a*, and then the liquid supplied into the pressurizing chamber bodies 10*a* is collected from the first individual flow passages 12.

DESCRIPTION OF THE REFERENCE NUMERAL

1: Color inkjet printer
2,102,202: Liquid discharge head
4: First flow passage member
4*a*~4*m*: Plates (first plate)
6: Second flow passage member
8: Discharge hole
10,110,210: Pressurizing chamber
10*a*: Pressurizing chamber body
10*b*, 110*b*: Partial flow passage
12,212: First individual flow passage (first flow passage)
14,114,214: Second individual flow passage (fifth flow passage)
15,115,215: Discharge unit
16,116: Third individual flow passage (third flow passage)
20,120,220: First common flow passage (second flow passage)
22: First integrated flow passage
24,124,224: Second common flow passage (fourth flow passage)

26: Second integrated flow passage
30,130,230: Damper
30*a*,130*a*: First damper
30*b*,130*b*: Second damper
130*c*: Third damper
32,132,232: Space
32*a*,132*a*: First space
32*b*,132*b*: Second space
40: Piezoelectric actuator substrate
48: Displacement element (pressurizing section)
50: Housing
74*a*,74*b*,74*c*,74*d*: Conveying rollers
76: Control section
P: Recording medium
D1: First direction
D2: Second direction
D3: Third direction
D4: Fourth direction
D5: Fifth direction
D6: Sixth direction

The invention claimed is:

1. A liquid discharge head comprising:
a flow passage member comprising:
a plurality of discharge holes;
a plurality of pressurizing chambers respectively connected to the plurality of discharge holes;
a plurality of first flow passages respectively connected to the plurality of pressurizing chambers and supplying the plurality of pressurizing chambers with liquid respectively;
a second flow passage commonly connected to the plurality of first flow passages;
a plurality of third flow passages respectively connected to the plurality of pressurizing chambers and collecting liquid in the plurality of pressurizing chambers respectively; and
a fourth flow passage including a damper and commonly connected to the plurality of third flow passages; and
a plurality of pressurizing sections respectively pressurizing liquid in the plurality of pressurizing chambers,
wherein a flow passage resistance in the plurality of third flow passages is lower than a flow passage resistance in the plurality of first flow passages, and
wherein a space facing the fourth flow passage via the damper is formed.

2. A liquid discharge head comprising:
a flow passage member comprising:
a plurality of discharge holes;
a plurality of pressurizing chambers respectively connected to the plurality of discharge holes;
a plurality of first flow passages respectively connected to the plurality of pressurizing chambers;
a second flow passage commonly connected to the plurality of first flow passages;
a plurality of third flow passages respectively connected to the plurality of pressurizing chambers; and
a fourth flow passage including a damper and commonly connected to the plurality of third flow passages; and
a plurality of pressurizing sections respectively pressurizing liquid in the plurality of pressurizing chambers,
wherein a flow passage resistance in the plurality of third flow passages is lower than a flow passage resistance in the plurality of first flow passages, and
wherein a first damper is provided above the fourth flow passage and a second damper is provided under the fourth flow passage.

3. The liquid discharge head according to claim 2, wherein, when viewed in a plane, the plurality of third flow passages are each connected to a side surface of the fourth flow passage.

4. The liquid discharge head according to claim 3, wherein the plurality of third flow passages are each connected, on a side facing each of the plurality of pressurizing sections, to the fourth flow passage.

5. The liquid discharge head according to claim 4, wherein, when viewed in a cross section in a lamination direction, an upper surface of each of the plurality of third flow passages and an upper surface of the fourth flow passage are formed flush.

6. The liquid discharge head according to claim 5, wherein, in the flow passage member, a first plate of a plurality of plates comprises first holes forming the plurality of third flow passages, a second hole forming the fourth flow passage, and a plurality of partition walls each positioned between each of the first holes and the second hole, wherein the first holes are disposed on both sides of the second hole, and the first plate comprises connection sections connecting the plurality of partition walls facing each other via the second hole.

7. The liquid discharge head according to claim 6, wherein a thickness of each of the connection sections is thinner than a thickness of the first plate.

8. The liquid discharge head according to claim 2, wherein, when viewed in a cross section in a lamination direction, the fourth flow passage comprises a first portion, and a second portion positioned closer, than the first portion, to each of the plurality of discharge holes, a width of the second portion is greater than a width of the first portion, the first damper is disposed to face the first portion, the second damper is disposed to face the second portion, and a width of the second damper is greater than a width of the first damper.

9. The liquid discharge head according to claim 2, wherein, in the flow passage member, a third damper is formed in the second flow passage.

10. The liquid discharge head according to claim 9, wherein, when viewed in a cross section in a lamination direction, the second flow passage comprises a third portion, and a fourth portion positioned closer, than the third portion, to each of the plurality of discharge holes, a width of the fourth portion is greater than a width of the third portion, the third damper is disposed to face the fourth portion, and a width of the third damper is wider than a width of the third portion, but narrower than a width of the fourth portion.

11. The liquid discharge head according to claim 2, wherein, when viewed in a plane, a part of each of the plurality of pressurizing sections is disposed on the first damper.

12. A liquid discharge head comprising:
a flow passage member comprising:
a plurality of discharge holes;
a plurality of pressurizing chambers respectively connected to the plurality of discharge holes;
a plurality of first flow passages respectively connected to the plurality of pressurizing chambers;
a second flow passage commonly connected to the plurality of first flow passages;
a plurality of third flow passages respectively connected to the plurality of pressurizing chambers;

a fourth flow passage including a damper and commonly connected to the plurality of third flow passages; and a plurality of fifth flow passages respectively connected to the plurality of pressurizing chambers; and a plurality of pressurizing sections respectively pressurizing liquid in the plurality of pressurizing chambers, wherein the plurality of fifth flow passages are connected in common to the second flow passage, and a flow passage resistance in the plurality of third flow passages is lower than a flow passage resistance in the plurality of first flow passages and a flow passage resistance in the plurality of fifth flow passages.

13. A recording device comprising:

the liquid discharge head according to claim 1;

a conveyor for conveying a recording medium toward the liquid discharge head; and a control section for controlling the liquid discharge head.

14. The liquid discharge head according to claim 1, wherein, when viewed in a plane, a part of each of the plurality of pressurizing sections is disposed on the damper.

15. A recording device comprising:

the liquid discharge head according to claim 2;

a conveyor for conveying a recording medium toward the liquid discharge head; and a control section for controlling the liquid discharge head.

16. The liquid discharge head according to claim 12, wherein, when viewed in a plane, a part of each of the plurality of pressurizing sections is disposed on the damper.

17. A recording device comprising:

the liquid discharge head according to claim 12;

a conveyor for conveying a recording medium toward the liquid discharge head; and a control section for controlling the liquid discharge head.

* * * * *